US006229513B1

(12) United States Patent
Nakano et al.

(10) Patent No.: US 6,229,513 B1
(45) Date of Patent: May 8, 2001

(54) LIQUID CRYSTAL DISPLAY APPARATUS HAVING DISPLAY CONTROL UNIT FOR LOWERING CLOCK FREQUENCY AT WHICH PIXEL DRIVERS ARE DRIVEN

(75) Inventors: Shuuichi Nakano; Youichi Igarashi, both of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/090,340

(22) Filed: Jun. 4, 1998

(30) Foreign Application Priority Data

Jun. 9, 1997 (JP) ..... 9-151080

(51) Int. Cl.[7] ..... G09G 3/36

(52) U.S. Cl. ..... 345/99; 345/87; 345/93; 345/94; 345/96; 345/98; 345/100; 345/103; 345/212; 345/213

(58) Field of Search ..... 345/98, 99, 100, 345/87, 93, 94, 96, 103, 212, 213

(56) References Cited

U.S. PATENT DOCUMENTS 5,010,325 * 4/1991 Ziuchkovski .
5,196,738 * 3/1993 Takahara et al. ..... 327/530
5,252,957 * 10/1993 Itakura ..... 345/98
5,307,085 * 4/1994 Nakamura ..... 345/99
5,657,040 * 8/1997 Kanbara ..... 345/98
5,880,707 * 3/1999 Aratani ..... 345/100
5,900,857 * 5/1999 Kuwata et al. ..... 345/100
5,907,314 * 5/1999 Negishi et al ..... 345/103
5,929,832 * 7/1999 Furukawa et al. ..... 345/98
6,025,835 * 2/2000 Aoki et al. ..... 345/204

FOREIGN PATENT DOCUMENTS 10-97219 4/1998 (JP) .

OTHER PUBLICATIONS

*Nikkei Electronics*, Jul. 15, 1996 (No. 666), pp. 110–115.

* cited by examiner

*Primary Examiner*—Richard Hjerpe
*Assistant Examiner*—Henry N. Tran
(74) *Attorney, Agent, or Firm*—Antonelli, Terry, Stout & Kraus, LLP

(57) ABSTRACT

A liquid crystal display apparatus comprises a liquid crystal display panel having a plurality of pixels formed in a matrix configuration, M driving means for applying a plurality of pixels arranged in a column direction with video voltage based on display data, where M is a positive integer, and display control means for sending inputted display data to the M driving means, and for generating control signals including at least clock signals based on input display control signals inputted thereto and sending the control signals to the M driving means to control and drive the M driving means, wherein the display control means reorders originally ordered display data inputted thereto and sends the recorded display data to the M driving means, and generates N clock signals having the same frequency as and different phases from each other, where N is a positive integer smaller than M, and sends the N clock signals to N driving means groups, respectively.

17 Claims, 16 Drawing Sheets

SHD
SPC4
GC1
ML
POL1
VINC1
BM
VINC2
WSPC
POR
PRS
RFS
SPS
45°
SUB2
SUB1
POL2
GLB
ML
LF1

SUB2
SUB1
GLB
POL1
VINC2
ML
EP
EP
POR
VINC1
POL2
PRS
RFS
SPS
ML
LF2
45°
BM
GC1
LP
OL
SHD
IC1
LPC3
NOT
WSPC
DSPC
FPC2(b)
LS
FPC2(a)

LIQUID CRYSTAL DISPLAY APPARATUS HAVING DISPLAY CONTROL UNIT FOR LOWERING CLOCK FREQUENCY AT WHICH PIXEL DRIVERS ARE DRIVEN

BACKGROUND OF THE INVENTION

The present invention relates generally to a liquid crystal display apparatus, and more particularly to techniques which are effectively applied to enhance the resolution of a liquid crystal display panel.

An active matrix type liquid crystal display apparatus, which has an active element (for example, a thin film transistor) for each pixel and drives the active elements for switching, applies pixel electrodes with liquid crystal drive voltages (gradation voltages) through the active elements, so that no cross talk occurs between respective pixels. Since a special driving method is not required for preventing cross talk as is the case of a simple matrix type liquid crystal display apparatus, the active matrix type liquid crystal display provides for a multi-level gradation display.

As one type of the active matrix type liquid crystal display apparatus, there is known a TFT (Thin Film Transistor) based liquid crystal display module which comprises a TFT-based liquid crystal display panel (TFT-LCD); drain drivers disposed above the liquid crystal display panel; gate drivers disposed on one side of the liquid crystal display panel; and an interface unit.

In this TFT-based liquid crystal display module, the interface unit is composed of a display control unit and a power supply circuit. The power supply circuit generates drive voltages for applying to the drain drivers, the gate drivers, and a common electrode of the liquid crystal display panel.

The display control unit, formed of a single semiconductor integrated circuit (LSI), controls and drives the drain drivers and the gate drivers based on display control signals including clock signals, a display timing signal, a horizontal synchronization signal and a vertical synchronization signal, and data for display, all of which are transmitted from a computer side.

Each of the drain drivers latches display data, the amount of which corresponds to the number of output lines, in an input register unit based on a clock signal (D3) for latching display data (hereinafter referred to as the "clock signal D3") sent thereto from the display control unit. The drain driver also latches display data latched in the input register unit in a storage latch unit based on a clock signal (D1) for output timing control sent from the display control unit, and outputs video voltages corresponding to the respective display data latched in the storage latch unit to associated drain lines D of the liquid crystal display panel.

Each of the gate drivers sequentially conducts a plurality of thin film transistors (TFT) connected to associated gate signal lines G of the liquid crystal display panel for every one horizontal scan period based on a frame start instruction signal sent from the display control unit and a clock signal G1 in synchronism with the clock signal D1.

With the foregoing operations, an image is displayed on the liquid crystal display panel. Such techniques are described, for example, in Japanese Patent Application No. 8-247659 which was published as Japanese Laid-Open Patent Application No. 10-97219.

Conventionally, in liquid crystal display apparatus, a higher resolution has been required for liquid crystal display panels, and to meet the high resolution requirement, the resolution of liquid crystal display panels has been enhanced, for example, from 640×480 pixels in VGA (Video Graphics Array) display mode to 800×600 pixels in SVGA (Super Video Graphics Array) display mode.

In recent years, however, as larger screen sizes have been required for liquid crystal display panels, more enhanced resolutions have been needed for liquid crystal display apparatus, such as 1024×768 pixels in XGA (Extended Graphics Array) display mode, 1280×1024 pixels in SXGA (Super Extended Graphics Array) display mode, and 1600×1200 pixels in UXGA (Ultra Extended Graphics Array) display mode.

With the increasingly enhanced resolution of liquid crystal display panels as mentioned above, a display control unit, drain drivers and gate drivers, associated therewith, are also required to have high speed operation capabilities. Particularly, higher display operation frequencies are strongly needed for a clock signal (D3) and display data outputted from the display control unit to the drain drivers.

For example, a liquid crystal display panel having 1024×768 pixels in XGA display mode requires a clock signal (D3) at a frequency of 65 MHz and display data at a frequency of 32.5 MHz (one half of 65 MHz).

However, while display data at a frequency of 32.5 MHz may be recognized by the drain drivers, it is difficult for the drain drivers to recognize the clock signal (D3) at a frequency of 65 MHz since the clock signal (D3) is sent from the display control unit to the drain drivers through a signal line provided on a printed wiring board.

More specifically, a signal line provided on a printed wiring board is equivalent to an open-end distributed constant line. When the clock signal (D3) at a frequency of 65 MHz is transmitted through this open-end distributed constant line, the clock signal (D3) exhibits significant wave distortion which would cause difficulties in recognizing the clock signal (D3) with the drain driver.

On the other hand, in order to prevent other electronic devices from malfunctioning due to electromagnetic interference (EMI) noise radiated by an electronic device, electronic devices are regulated in terms of the amount of radiated electromagnetic waves generated thereby. To comply with this regulation, the liquid crystal display modules are also provided with means as countermeasures for reducing the amount of radiated electromagnetic waves generated thereby (so-called unnecessary radiation countermeasures). In this case, however, as the frequency of a clock signal is higher, it becomes more difficult to take countermeasures for reducing electromagnetic interference noise radiated from a printed wiring board.

As is apparent from the foregoing, conventional liquid crystal display apparatus imply the following problems: difficulties in sending a high frequency clock signal (D3) from a display control unit to drain drivers when using a higher resolution liquid crystal display panel which is required with an increase in screen size of a liquid crystal display panel; and difficulties in taking countermeasures for preventing unnecessary radiation, even if a high frequency clock signal (D3) could be sent.

BRIEF SUMMARY OF THE INVENTION

It is an object of the present invention to provide techniques for use in a liquid crystal display apparatus for lowering the frequency of clock signals sent to driving means, using similar driving means to those encountered in conventional liquid crystal display apparatus, without increasing the bus width of a bus line for transmitting display data therethrough.

The above and novel features of the present invention will become apparent from the following detailed description of the preferred embodiments and accompanying drawings.

According to one aspect of the present invention, a liquid crystal display apparatus comprises a liquid crystal display panel having a plurality of pixels formed in a matrix configuration, M driving means (M being a positive integer) for applying a plurality of pixels arranged in a column direction with video voltage based on display data, where M is a positive integer, and display control means for sending inputted display data to the M driving means, and for generating control signals including at least clock signals based on input display control signals inputted thereto and sending the control signals to the M driving means to control and drive the M driving means, wherein the display control means, for lowering the frequency of clock signals sent to the driving means, generates N clock signals (N being a positive integer smaller than M) having the same frequency as and different phases from each other, where N is a positive integer smaller than M, and sends the N clock signals to N driving means groups, each of the driving means groups comprising (M/N) driving means, and reorders originally ordered display data inputted thereto and sends the reordered display data to the M driving means.

DETAILED DESCRIPTION OF THE INVENTION

Figure 1:
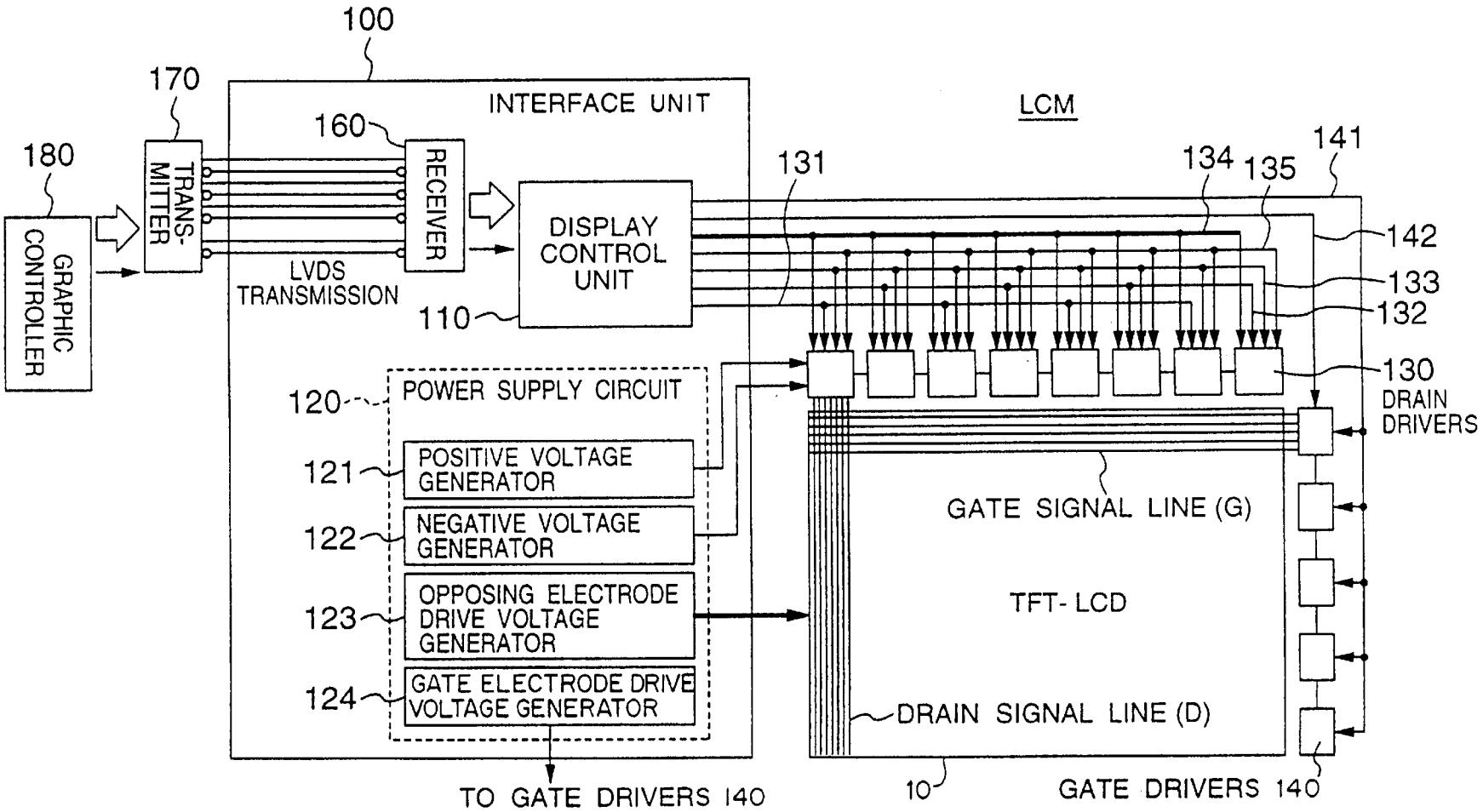
FIG. 1 is a block diagram illustrating a general configuration of a TFT-based liquid crystal display module according to one embodiment of the present invention.

The present invention will hereinafter be described in connection with several embodiments thereof with reference to the accompanying drawings.

It should be first noted that in all figures for describing embodiments of the present invention, elements having the same functions are designated the same reference numerals, and repetitive explanation thereon is omitted.

FIG. 1 is a block diagram illustrating a general configuration of a TFT-based liquid crystal display module according to an embodiment of the present invention.

The liquid crystal display module (LCM) of this embodiment has drain drivers 130 disposed above a liquid crystal display panel (TFT-LCD) 10, and gate drivers 140 and an interface unit 100 disposed on one side of the liquid crystal display panel 10.

The interface unit 100 is mounted on an interface board, while the drain drivers 130 and gate drivers 140 are likewise mounted on their dedicated printed wiring boards.

The liquid crystal display module of this embodiment also employs a digital interface as an interface with the computer side. Specifically, in this embodiment, display control signals including a clock signal CK, a display timing signal DTMG, a horizontal synchronization signal Hsync, a vertical synchronization signal Vsync, and display data (R, G, B) are sent from the computer side in accordance with a LVDS (Low Voltage Differential Signaling) scheme.

As illustrated in FIG. 1, a transmitter 170 and a receiver 160, each formed of a semiconductor integrated circuit (LSI), are disposed between an output stage of a graphic controller 180 on the computer side and an input stage of a display control unit 110.

The transmitter 170 converts signals of a total of 21 bits, including control signals containing the display timing signal DTMG, the horizontal synchronization signal Hsync and the vertical synchronization signal Vsync and including the display data (R, G, B), from the graphic controller 180, from a parallel form to a serial form, and sends the serial signal to the receiver 160 through three twisted pair lines.

The receiver 160 converts the serial signal to the original parallel signals, and sends the recovered display timing signal DTMG, horizontal synchronization signal Hsync, vertical synchronization signal Vsync and display data (R, G, B) to the display control unit 110.

The clock signal CK in turn is transmitted from the transmitter 170 to the receiver 160 through a single twisted pair line.

Here, the frequency of the serial signal on the three twisted pair lines is seven times higher than the frequency of the clock signal CK.

The aforementioned LVDS (Low Voltage Differential Signaling) scheme is described in *Nikkei Electronics*, Jul. 15, 1996 (No. 666), pp. 110–115. (Alternately, reference may be made to *LVDS Owner's Manual,* 1997, National Semiconductor Corporation.)

Figure 2:
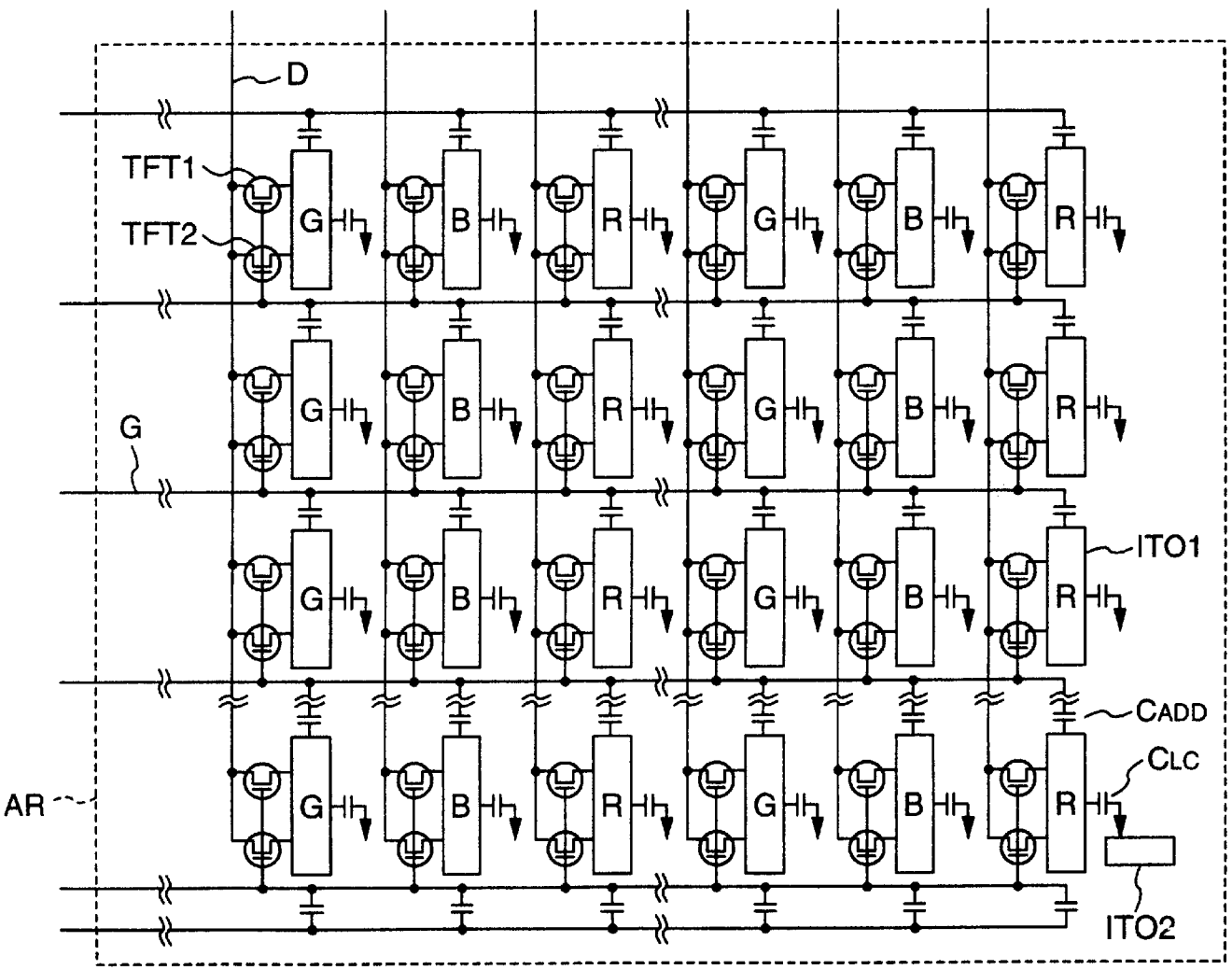
FIG. 2 is a circuit diagram representing an equivalent circuit for an example of a liquid crystal display panel illustrated in FIG. 1.

FIG. 2 represents an equivalent circuit for an example of the liquid crystal display panel 10 illustrated in FIG. 1.

FIG. 2, though drawn in a circuit diagram form, illustrates components corresponding to actual geometrical positions. As illustrated, the liquid crystal display panel 10 has a plurality of pixels arranged in a matrix configuration.

Each pixel is disposed within an area defined by two adjacent first signal lines (drain signal lines D or gate signal lines G) and two adjacent second signal lines (gate signal lines G or drain signal lines D) intersecting therewith.

Each pixel has a thin film transistor TFT, where the thin film transistor TFT in each pixel has a source electrode connected to a pixel electrode ITO1, and a liquid crystal layer LC is formed between the pixel electrode ITO1 and a common electrode ITO2, so that a liquid crystal capacitance CLC is equivalently connected between the source electrode and the common electrode ITO2 of the thin film transistor TFT.

An additional capacitance CADD is also connected between the source electrode of the thin film transistor TFT (pixel electrode) and a gate signal line G of the preceding stage.

Figure 3:
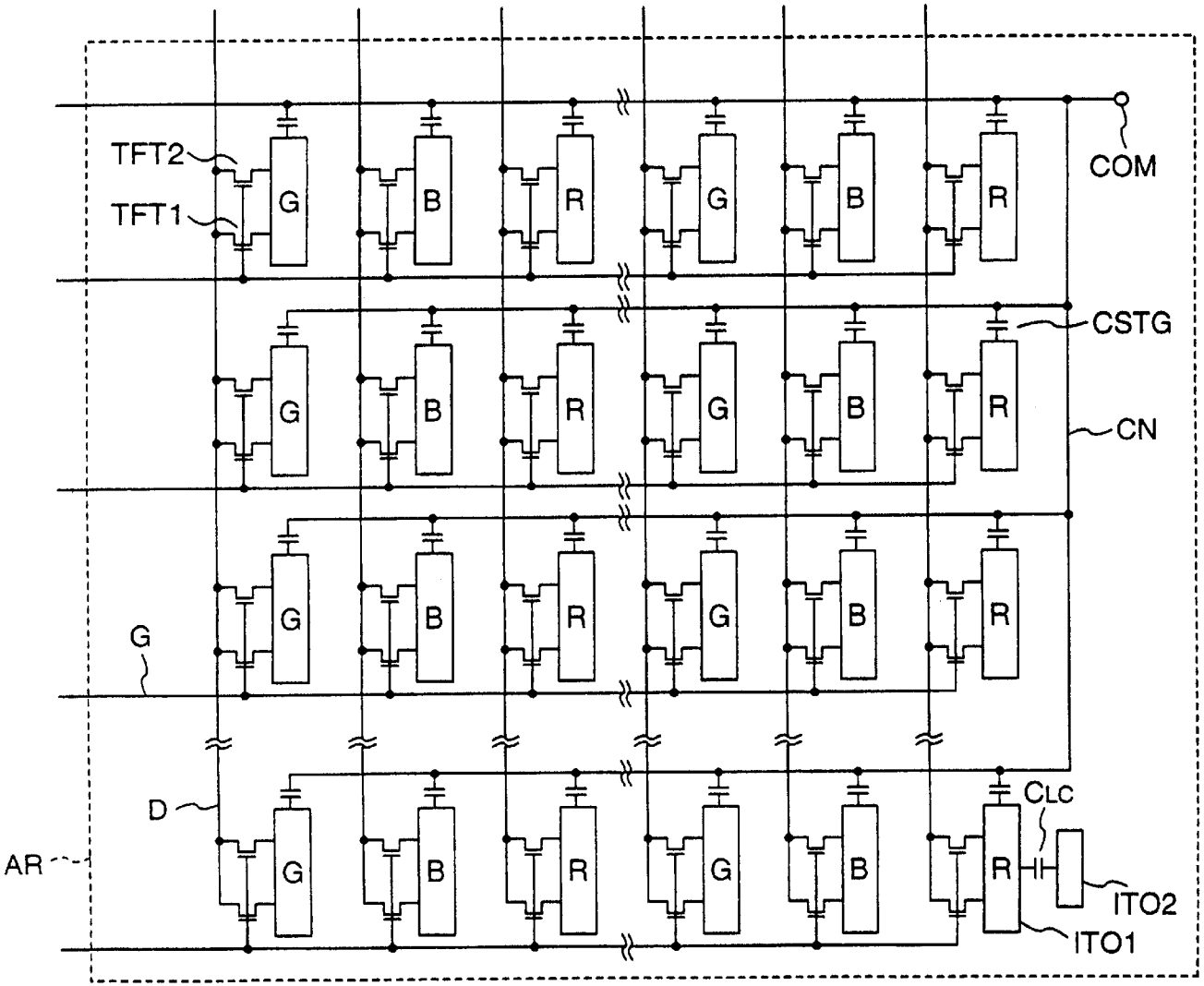
FIG. 3 is a circuit diagram representing an equivalent circuit for another example of the liquid crystal display panel illustrated in FIG. 1.

FIG. 3 represents an equivalent circuit for another example of the liquid crystal display panel 10 illustrated in FIG. 1.

The example represented by the equivalent circuit of FIG. 2 differs from the example represented by the equivalent circuit of FIG. 3 in that the former has the additional capacitance formed between the gate signal line G of the preceding stage and the pixel electrode, while the latter has a storage capacitance CSTG between a common signal line COM and a source electrode. Reference symbol CN represents a conductor for connecting respective common signal lines COM together.

While the present invention is applicable to either of the two configurations, a pulse on the gate signal line G of the preceding stage plunges into the pixel electrode ITO1 through the additional capacitance CADD in the former configuration, whereas the latter configuration provides for better display since the plunge does not occur. The circuit diagrams of FIGS. 2 and 3 has a display area AR defined by a dotted rectangle.

In the liquid crystal display panel 10 illustrated in FIG. 2 or 3, drain electrodes of thin film transistors TFT in respective pixels arranged in a column direction are connected to associated drain signal lines D, and the drain signal lines D are connected to associated drain drivers 130 for applying video voltages (display data voltages) to liquid crystal of the pixels arranged in the column direction.

Also, gate electrodes of thin film transistors TFT in respective pixels arranged in a row direction are connected to associated gate signal lines G, and the gate signal lines G are connected to associated gate drivers 140 for supplying the gates of the thin film transistors TFT with a scan drive voltage (a positive bias voltage or a negative bias voltage) for one horizontal scan period. Here, the liquid crystal display panel 10 illustrated in FIG. 1 comprises a matrix of 1024×3×768 pixels.

The interface unit 100 illustrated in FIG. 1 is composed of the display control unit 110 and a power supply circuit 120.

The display control circuit 110 is formed of a single semiconductor integrated circuit (LSI) for controlling and driving the drain drivers 130 and the gate drivers 140 based on the display control signals including the clock signal CK, the display timing signal DTMG, the horizontal synchronization signal Hsync and the vertical synchronization signal Vsync, and the display data (R, G, B), all of which are transmitted thereto from the computer side.

In this case, the display control unit 110 generates from the clock signal CK from the computer side, a first clock signal D4 (hereinafter referred to as the "clock signal D4") as a clock signal for latching display data, and a second clock signal D5 (hereinafter referred to as the clock signal D5") having the same frequency as and a different phase from the first clock signal D4. In this embodiment, the clock signal D5 is an inverted version of the clock signal D4.

The clock signal D4 is transmitted to a group A of drain drivers 130 (odd-numbered drain drivers 130 in FIG. 1) through a signal line 131. The clock signal D5 in turn is transmitted to a group B of drain drivers 130 (even-numbered drain drivers 130 in FIG. 1) through a signal line 132.

In response, the display control unit 110 reorders originally ordered display data received from the computer side, and outputs the reordered display data to the drain drivers 130 through a display data bus line 134.

The display control unit 110 also outputs a clock signal D1 for controlling output timing (hereinafter referred to as "clock signal D1") to the drain drivers 130 through a signal line 133 when display data are completed for one horizontal scan period. The display control unit 110 outputs an output polarity control signal (hereinafter referred to as "an alternating signal") to the drain drivers 130 through a signal line 135.

Further, the display control unit 110 outputs a frame start instruction signal to the gate drivers 140 through a signal line 142, and outputs a shift clock signal G1 for sequentially selecting each gate signal line G of the liquid crystal display panel 10 (hereinafter referred to as the "clock signal G1") to the gate drivers 140 through a signal line 141 for every one horizontal scan period.

Figure 4A:
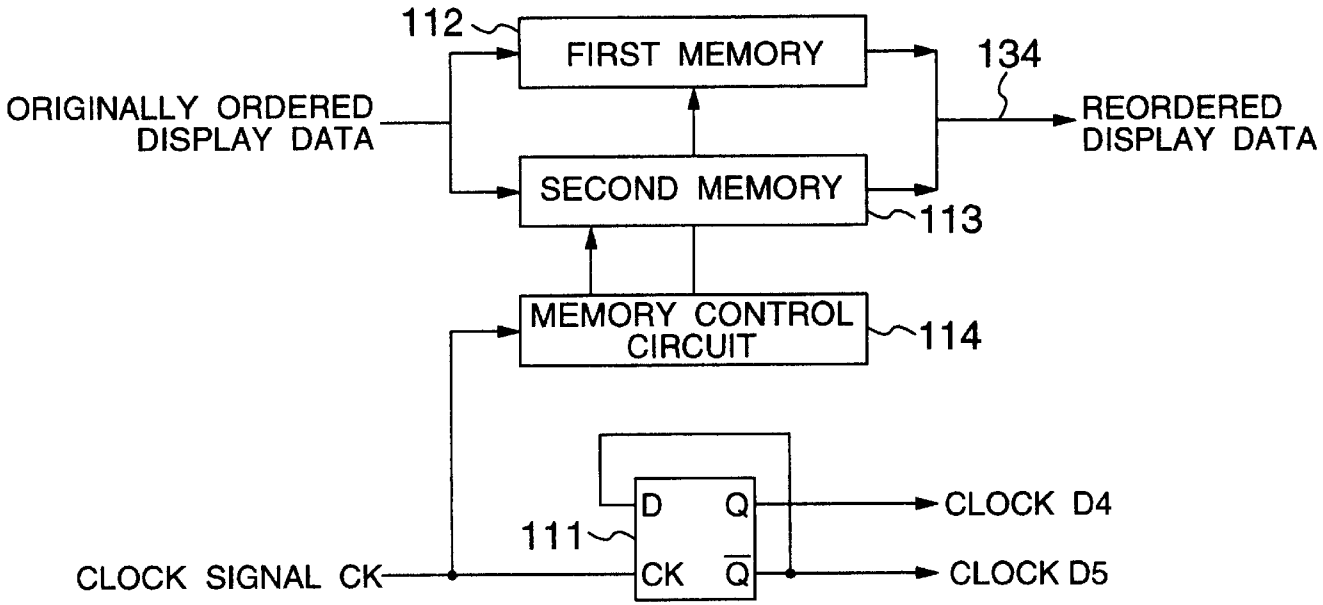
FIG. 4A is a block diagram illustrating an exemplary circuit configuration of a portion for reordering display data and a portion for generating clock signals in a display control unit illustrated in FIG. 1.
Figure 4B:
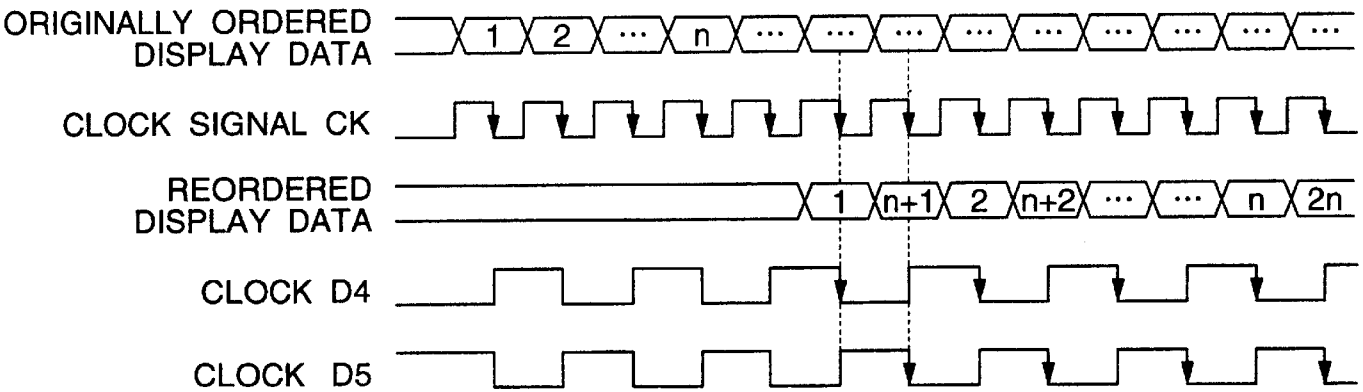
FIG. 4B illustrates timing charts of display data and clock signals sent from the display control unit.

FIG. 4A illustrates an example of a circuit configuration of a portion for reordering display data and a portion for generating the clock signals D4, D5 in the display control unit 110 illustrated in FIG. 1, and FIG. 4B illustrates timing charts of display data and the clock signals D4, D5 sent from the display control unit 110.

In the example illustrated in FIG. 4A, a clock signal CK at 65 MHz transmitted from the computer side is divided by a D-type flip-flop 111 such that clock signals D4, D5 at 32.5 MHz as illustrated in FIG. 4B are outputted from a noninverting output terminal Q and an inverting output terminal $\overline{Q}$ of the D-type flip-flop 111, respectively.

Also, originally ordered display data transmitted from the computer side are inputted to a first memory 112 (or a second memory 113). The first memory 112 (and the second memory 113) stores display data of an amount corresponding to a total number 2n of the drain signal lines D connected to two drain drivers 130 (n being a positive integer).

In the example illustrated in FIG. 4A, the 2n originally ordered display data transmitted from the computer side are first written, for example, into the first memory 112. When 2n display data are stored in the first memory 112, next 2n display data transmitted from the computer side are written into the second memory 113, and meanwhile the display data are read from the first memory 112 in an order shown in FIG. 4B and outputted to the drain drivers 130 through the display data bus line 134.

A memory control circuit 114 controls writing and reading operations of the first and second memories 112, 113.

As illustrated in the time charts of FIG. 4B, a falling (or rising) time of the clock signal D4 is set to be positioned near the center of two successive transition times of the display data. The present invention, however, is not limited to this particular setting, and the falling time of the clock signal D4 may be positioned at any intermediate time between two successive transition times of the display data. Also, the clock signal D5 need not be out of phase by π from the clock signal D4. Further, in this embodiment, while the clock signals D4, D5 are used as clock signals for latching display data, clock signals for this purpose are not limited to the two clock signals. Alternatively, four clock signals may be used.

As described above, according to this embodiment, the clock signals D4, D5 at 32.5 MHz, which is the same frequency as that of the display data, are transmitted alternately to the groups A and B of the drain drivers 130 (every other drain drivers 130), and reordered display data are transmitted to the respective drain drivers 130 through a single bus line, i.e., the bus line 134, thereby making it possible to transmit the display data from the display control unit 110 to the drain drivers 130 without increasing the bus width of the display data bus line 134.

Figure 5A:
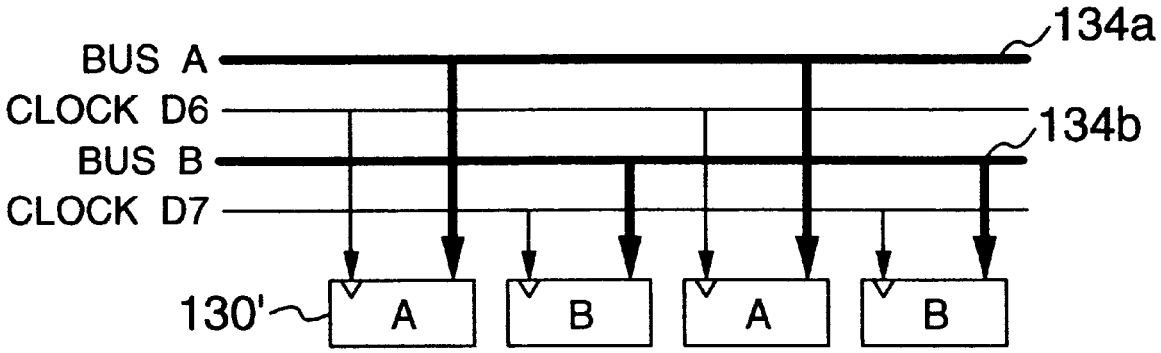
FIG. 5A is a block diagram illustrating an exemplary approach, considered by the present inventors and others, for transmitting a display data from the display control unit to drain drivers when a liquid crystal display panel has a high resolution.
Figure 5B:
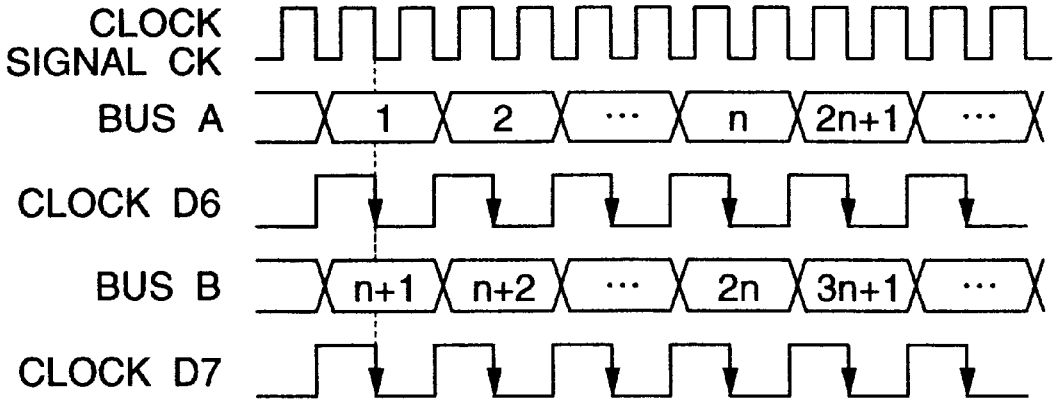
FIG. 5B is a timing chart illustrating the transmission of the display data in FIG. 5A.

FIG. 5A is a block diagram illustrating an exemplary approach, considered by the inventors of the present invention before creating this embodiment, for transmitting display data from the display control unit 110 to the drain drivers 130 when a liquid crystal display panel has a resolution of 1024×768 pixels. FIG. 5B is a timing chart of display data BUS A and BUS B and clock signals D6 and D7 fed from the display control unit.

The approach illustrated in FIGS. 5A, 5B provides two bus lines 134*a*, 134*b* as display data bus lines, and drain drivers 130' are connected alternately to the two bus lines 134*a*, 134*b* to simultaneously control every two drain drivers 130'. In this way, the approach illustrated in FIGS. 5A, 5B can lower the frequency of the clock signals D6, D7 for latching display data to 32.5 MHz (one half of 65 MHz).

The approach illustrated in FIGS. 5A, 5B, however, requires a twice wider bus width for the display data bus line (for example, 36 (6×3×2) bits for 64 levels of gradation, and 48 (8×3×2) bits for 256 levels of gradation), thereby causing an increase in the number of pins required for the display control unit 110, an increase in the number of layers and the area of a printed wiring board, on which the display control unit 110 is mounted. This further leads to an increased cost for the display control unit 110 and the associated printed wiring board, and a larger size of a connector attached to the printed wiring board for connecting the interface unit 100 with the drain drivers 130.

According to this embodiment, however, since the frequency of the clock signal for latching display data can be lowered to 32.5 MHz only by adding a signal line for the clock signal D4 or the clock signal D5 without the need for increasing the bus width of the display data bus line 134, it is possible to avoid an increase in the number of pins required for the display control unit 110, an increase in the number of layers and the area of a printed wiring board, on which the display control unit 110 is mounted. In addition, since a reduced number of EMI (electromagnetic interference) filters may be inserted into the display data bus line 134, an associated increase in cost can be minimized for the drain drivers 130 and the printed wiring board.

Turning back to FIG. 1, the power supply circuit 120 is composed of a positive voltage generator 121, a negative voltage generator 122, a common electrode (opposing electrode) drive voltage generator 123 and a gate electrode drive voltage generator 124.

The positive voltage generator 121 and the negative voltage generator 122 each comprise a voltage divider of series-connected resistors for outputting gradation reference voltages of positive polarity in five levels V0–V4 and gradation reference voltages of negative polarity in five levels V"5–V"9, respectively. These positive-polarity gradation reference voltages V0–V4 and negative-polarity gradation reference voltages V"5–V"9 are supplied to the respective drain drivers 130. The respective drain drivers 130 are also supplied with an AC alternating signal (alternating timing signal M), later described, from the display control unit 110 through a signal line 135.

The common electrode drive voltage generator 123 generates a drive voltage applied to the common electrode ITO2, while the gate electrode drive voltage generator 124 generates a drive voltage (a positive bias voltage or a negative bias voltage) applied to the gate of each thin film transistor TFT.

Generally, when a liquid crystal layer LC is being applied with the same voltage (direct current voltage) for a long time period, the inclination of the liquid crystal layer LC is fixed, which results in an after-image phenomenon, leading to a reduced lifetime of the liquid crystal layer LC.

To prevent this disadvantage, conventional liquid crystal display apparatus alternate a liquid crystal drive voltage applied to a liquid crystal layer LC at regular time intervals. More specifically, the liquid crystal drive voltage applied to each pixel electrode ITO1 is alternately changed to the positive voltage side and the negative voltage side at regular time intervals with reference to a liquid crystal drive voltage at a common electrode ITO2.

As a driving method for applying a liquid crystal layer LC with an alternating voltage, there are two known methods: a common DC drive method and a common inversion drive method. The common inversion drive method alternately inverts voltages applied to a common electrode ITO2 and a pixel electrode ITO1, while the common DC drive method applies a common electrode ITO2 with a fixed voltage and alternately inverts a voltage applied to a pixel electrode ITO1 to negative and positive with reference to the voltage applied to the common electrode ITO2.

Although the common DC drive method may not be fully satisfactory in that the amplitude of the voltage applied to the pixel electrode ITO1 is double as compared with the common inversion method so that a low voltage driver cannot be used, a dot inversion drive method or a V-line inversion drive method (both belonging to the common DC drive method), which exhibits lower power consumption and higher display quality, may be used.

The liquid crystal display module according to this embodiment therefore employs the dot inversion method as its driving method.

Figure 6:
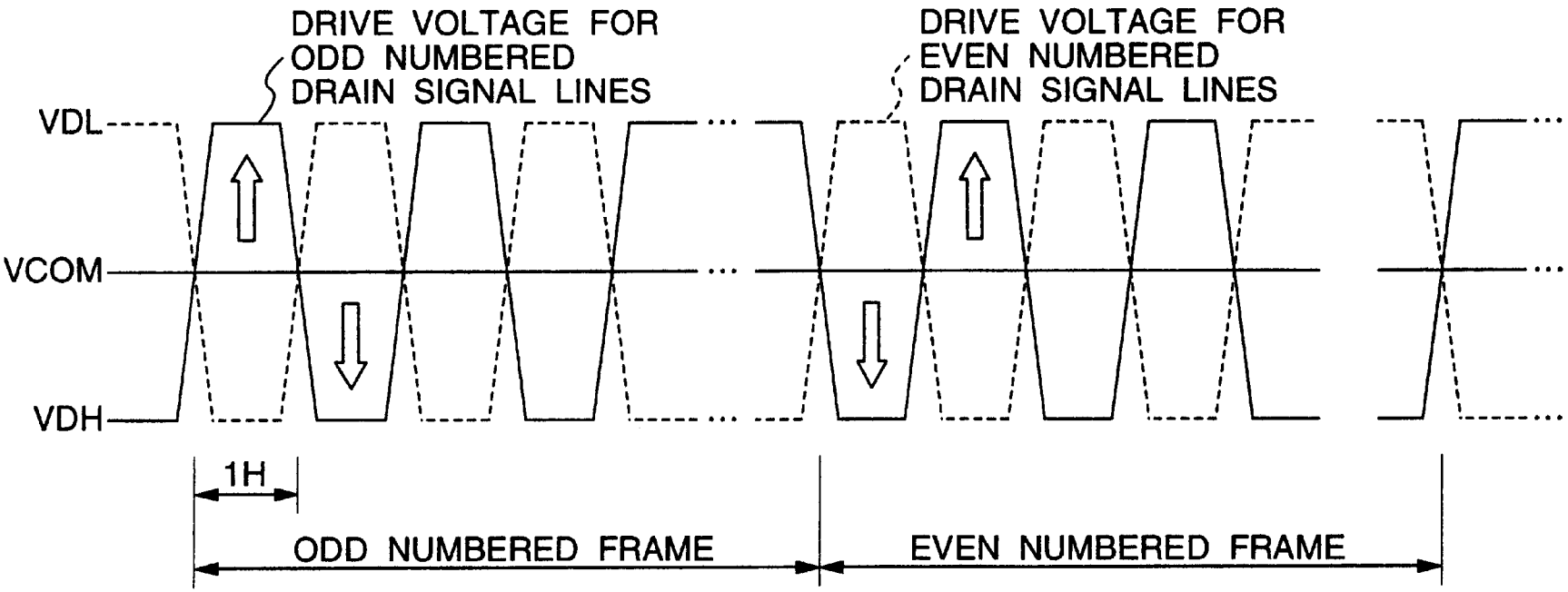
FIG. 6 is a diagram representing the relationship between liquid crystal drive voltages outputted from drain drivers illustrated in FIG. 1 to drain signal lines, i.e., liquid crystal drive voltages applied to pixel electrodes and a liquid crystal display voltage applied to a common electrode.

FIG. 6 is a waveform chart representing the relationship between liquid crystal drive voltages outputted from the drain drivers 130 illustrated in FIG. 1 to the drain signal lines D, i.e., liquid crystal display voltages applied to the pixel electrodes ITO1 and a liquid crystal drive voltage applied to the common electrode ITO2.

It should be noted that in FIG. 6, the liquid crystal drive voltages outputted from the drain drivers 130 to the drain signal lines D indicate liquid crystal drive voltages which are generated when a black color is displayed on the display screen of the liquid crystal display panel 10.

As illustrated in FIG. 6, a liquid crystal drive voltage VDH outputted to odd-numbered drain signal lines D from the drain drivers 130 is in a polarity inverted relationship with a liquid crystal drive voltage VDL outputted to even-numbered drain signal lines D from the drain drivers 130 with respect to a liquid crystal drive voltage VCOM applied to the common electrode ITO2. In other words, when the liquid crystal drive voltage VDH outputted to the odd-numbered drain signal lines D is in positive polarity (or negative polarity), the liquid crystal drive voltage VDL outputted to the even-numbered drain signal lines D is in negative polarity (or positive polarity).

The polarities of the respective drive voltages are inverted for every line, and the polarities for respective lines are inverted for every frame.

Since the use of the dot inversion method causes voltages applied to adjacent signal lines D to be in inverted polarities, currents flowing into the common electrode ITO2 and the gate electrodes G cancel with adjacent ones, thereby making it possible to reduce power consumption.

In addition, since a current flowing into the common electrode ITO2 is small to cause a fewer voltage drop, the voltage level at the common electrode ITO2 is stabilized, thereby making it possible to minimize a degraded display quality.

Figure 7:
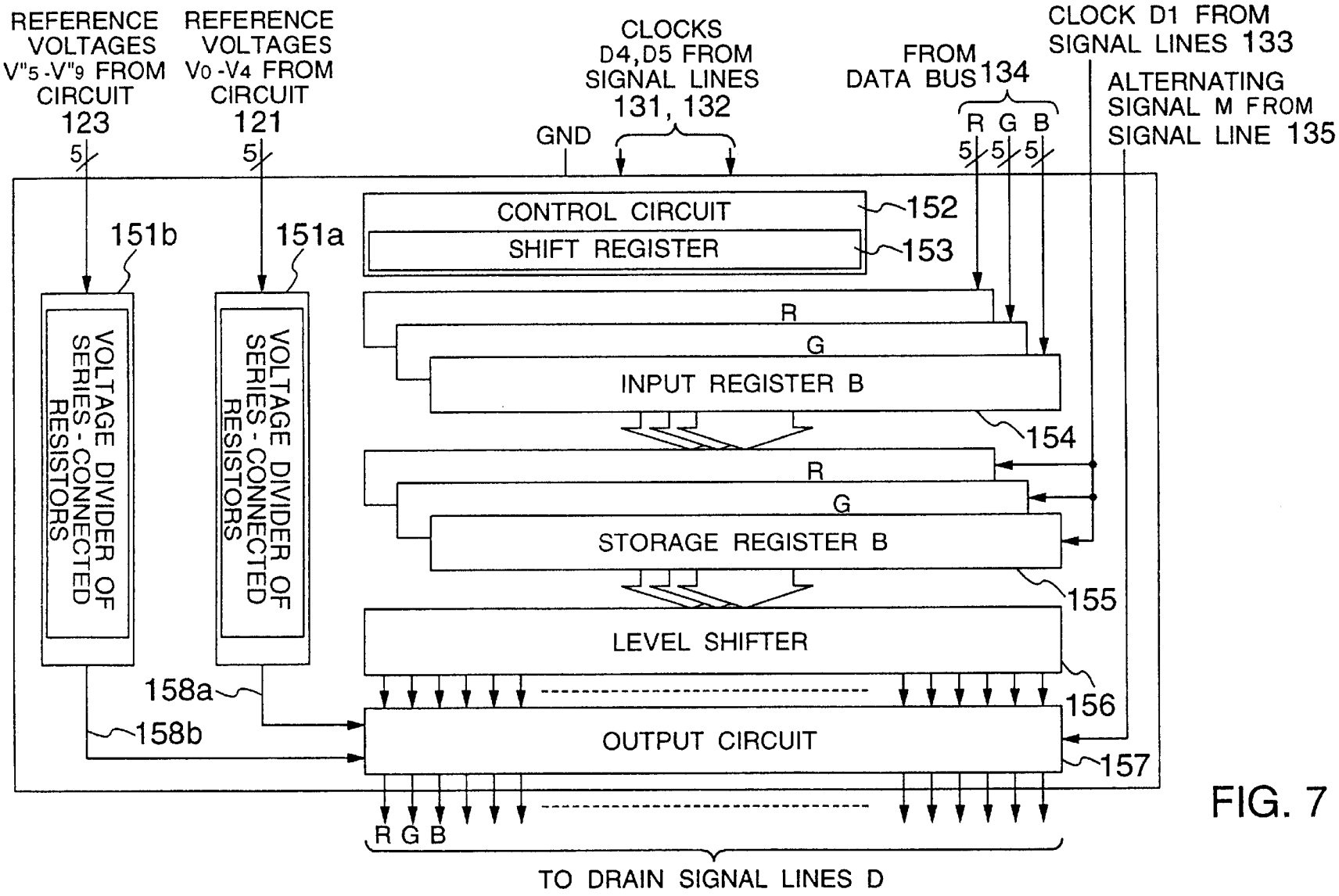
FIG. 7 is a block diagram illustrating a general configuration of an example of the drain driver illustrated in FIG. 1.

FIG. 7 is a block diagram illustrating a general configuration of an example of the drain driver 130 illustrated in FIG. 1.

Referring specifically to FIG. 7, a positive-polarity gradation voltage generator 151*a* generates 64 levels of gradation voltage in positive polarity based on five positive-polarity gradation reference voltage values V0–V4 inputted from the positive voltage generator 121, and outputs the generated gradation voltage to an output circuit 157 through a voltage bus line 158*a*. A negative-polarity gradation voltage generator 151*b*, in turn, generates 64 levels of gradation voltage in negative polarity based on five negative-polarity gradation reference voltage values V"5–V"9 inputted from the negative voltage generator 122, and outputs the generated gradation voltage to the output circuit 157 through a voltage bus line 158*b*.

A shift register 153 in a control circuit 152 of the drain driver 130 generates a data fetch signal for an input register 154 based on a clock D4 or D5 for latching display data inputted from the display control unit 110, and outputs the data fetch signal to the input register 154.

The input register 154 latches 6-bit display data for each color, the amount of which corresponds to the number of output lines, based on the data fetch signal outputted from the shift register 153 in synchronism with the clock D4 or D5 for latching display data inputted from the display control unit 110.

A storage register 155 latches display data in the input register 154 in response to an output timing control clock D1 inputted from the display control unit 110. The display data fetched in the storage register 155 are inputted to the output circuit 157 through a level shifter 156 which serves to boost voltages of the display data from the storage register 155.

The output circuit 157 delivers to the drain signal lines D outputs of a polarity depending on the alternating signal M supplied from the display control unit 110.

Figure 8:
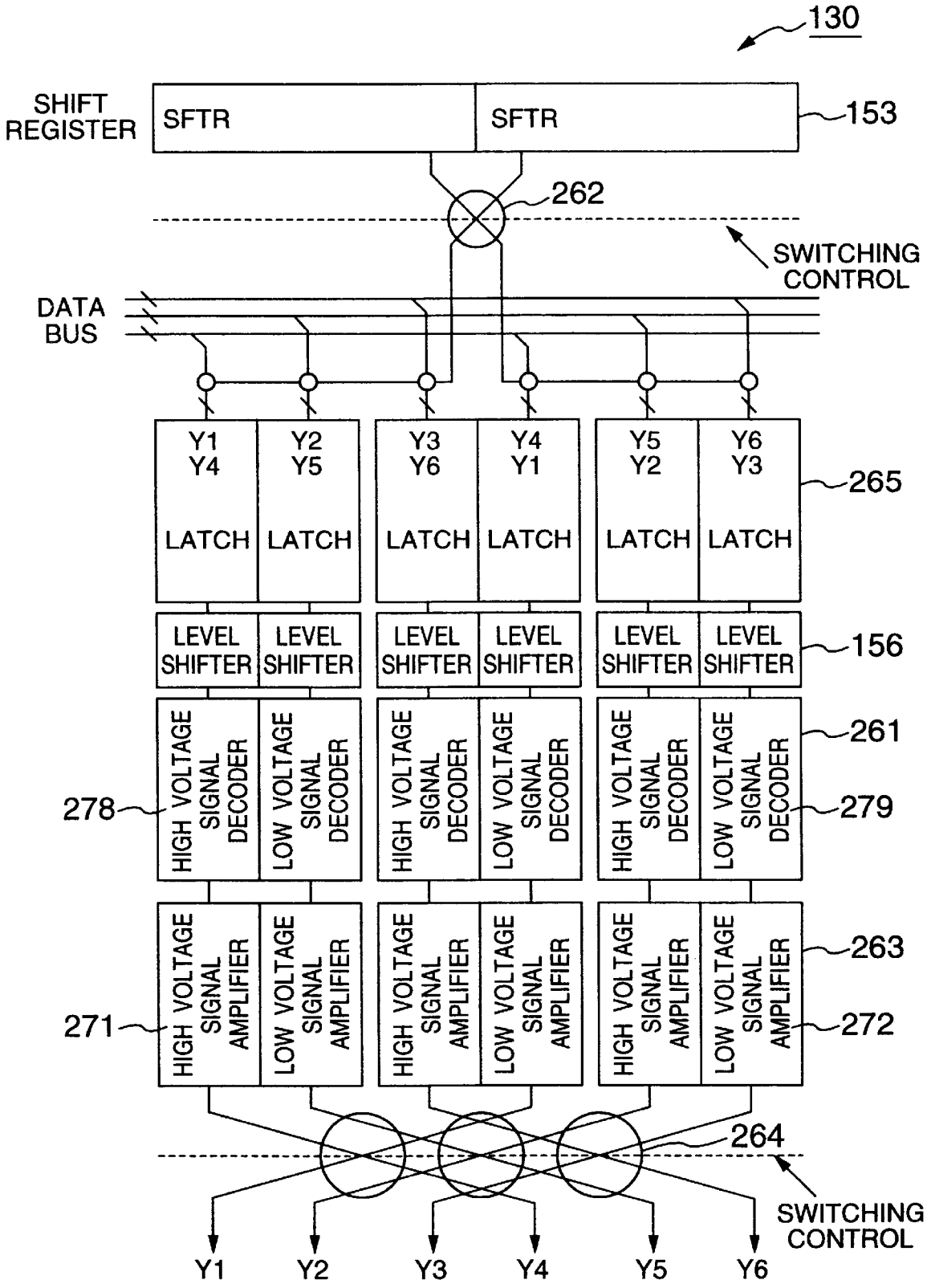
FIG. 8 is a block diagram for describing the configuration of the drain driver illustrated in FIG. 7, centered on the configuration of an output circuit in the drain driver illustrated in FIG. 7.

FIG. 8 is a block diagram for describing the configuration of the drain driver 130 illustrated in FIG. 7, centered on the configuration of the output circuit 157.

Referring specifically to FIG. 8, the drain driver 130 comprises the shift register 153 in the control circuit 152, level shifters 156, decoder units 261, a first switch 262, amplifier pairs 263, a second switch 264, and data latches 265. First, second, third, fourth, fifth and sixth drain signal lines D are indicated by Y1, Y2, Y3, Y4, Y5, Y6, respectively.

In FIG. 8, the decoder units 261, the amplifier pairs 263 and the second switch 264 for switching outputs of the amplifier pairs 263 constitute the output circuit 157 illustrated in FIG. 7, and the data latches 265 represent the input register 154 and the storage register 155 illustrated in FIG. 7. The first switch 262 and the second switch 264 are controlled based on an alternating signal D2.

In the drain driver 130 of this embodiment, the first switch 262 is used to switch a data fetch signal inputted to the data latches 265 (more specifically, the input register 154 illustrated in FIG. 7) so that the data fetch signal is inputted to adjacent data latches 265.

Each of the decoder units 261 is composed of a high voltage signal decoder 278 for selecting a gradation voltage corresponding to display data outputted from each data latch 265 (more specifically, the storage register 155 illustrated in FIG. 7) from 64 levels of positive-polarity gradation voltage outputted from the gradation voltage generator 151*a* through the voltage bus line 158*a*, and a low voltage signal decoder 279 for selecting a gradation voltage corresponding to display data outputted from each data latch 265 from 64 levels of negative-polarity gradation voltage outputted from the gradation voltage generator 151*b* through the voltage bus line 158*b*.

Two pairs of the high voltage signal decoders 278 and the low voltage signal decoders 279 are collectively assigned to every two adjacent data latches 265. Here, a voltage level of the negative-polarity gradation voltage inputted to the low voltage signal decoder 279 is, for example, in a range of 0 to 4 volts, so that the low voltage signal decoder 279 may be formed of a low break-down MOS transistor.

On the contrary, a voltage level of the positive-polarity gradation voltage inputted to the high voltage signal decoder 278 is, for example, in a range of 4 to 8 volts, so that the high voltage signal decoder 278 is formed of a high break-down MOS transistor. For this reason, the voltage level of display data must be converted to a high voltage range, for example, in a range of 4 to 8 volts by the level shifter 156 connected to the high voltage signal decoder 278.

While the embodiment illustrated in FIG. 8 has been described in connection with the use of a positive (+) power supply, the low voltage signal decoder 279 may be formed of a high break-down MOS transistor, if a negative (–) power supply is used.

Also, the embodiment illustrated in FIG. 8 is described below for the case where all the level shifters 156 convert the voltage levels of display data to higher levels and the high voltage signal decoders 278 and the low voltage signal decoders 279 are both formed of high break-down MOS transistors.

Each amplifier pair 263 is composed of a high voltage signal amplifier 271 and a low voltage signal amplifier 272. The high voltage signal amplifier 271 is supplied with a positive-polarity gradation voltage selected by the high voltage signal decoder 278, and outputs a positive-polarity liquid-crystal drive voltage. The low voltage signal amplifier 272 in turn is supplied with a negative-polarity gradation voltage selected by the low voltage signal decoder 279, and outputs a negative-polarity liquid crystal drive voltage.

In the dot inversion method, adjacent liquid crystal drive voltages for each color have polarities reverse to each other, and the high voltage signal amplifiers 271 and the low voltage signal amplifiers 272 in the amplifier pairs 263 are arranged alternately such as high voltage signal amplifier 271→low voltage signal amplifier 272→high voltage signal amplifier 271→low voltage signal amplifier 272. Therefore, the data fetch signal inputted to the data latches 265 is switched by the first switch 262 to input the data fetch signal to the adjacent data latches 265, and output voltages outputted from the high voltage signal amplifiers 271 or the low voltage signal amplifiers 272 are correspondingly switched by the second switch 264 to deliver the output signals to the drain signal lines D to which the liquid crystal drive voltage is outputted for each color, for example, to the first drain signal line Y1 and the fourth drain signal line Y4, whereby a positive-polarity or negative-polarity liquid crystal display voltage can be outputted to the respective drain signal lines D.

By forming the high voltage signal decoders 278 and the low voltage signal decoders 279 of high break-down MOS transistors of the same polarity, a chip area required for a semiconductor integrated circuit for implementing these decoders can be reduced as compared with the high voltage signal decoders 278 and the low voltage signal decoders 279 formed of complementary MOS transistor circuits comprising high break-down PMOS transistors and high break-down NMOS transistors.

Since the drain driver 130 illustrated in FIG. 8 can use a voltage follower circuit as an amplifier for outputting a positive-polarity liquid crystal drive voltage, a semiconductor integrated circuit (IC chip) for implementing the drain driver 130 can be reduced in chip size.

Also, since a voltage follower circuit has a large input impedance, no current will flow into the voltage follower circuit from the voltage bus lines 158*a*, 158*b*, thereby eliminating fluctuations in voltage level of the positive-polarity gradation voltage generator 151*a* or the negative-polarity gradation voltage generator 151*b*.

Figure 9:
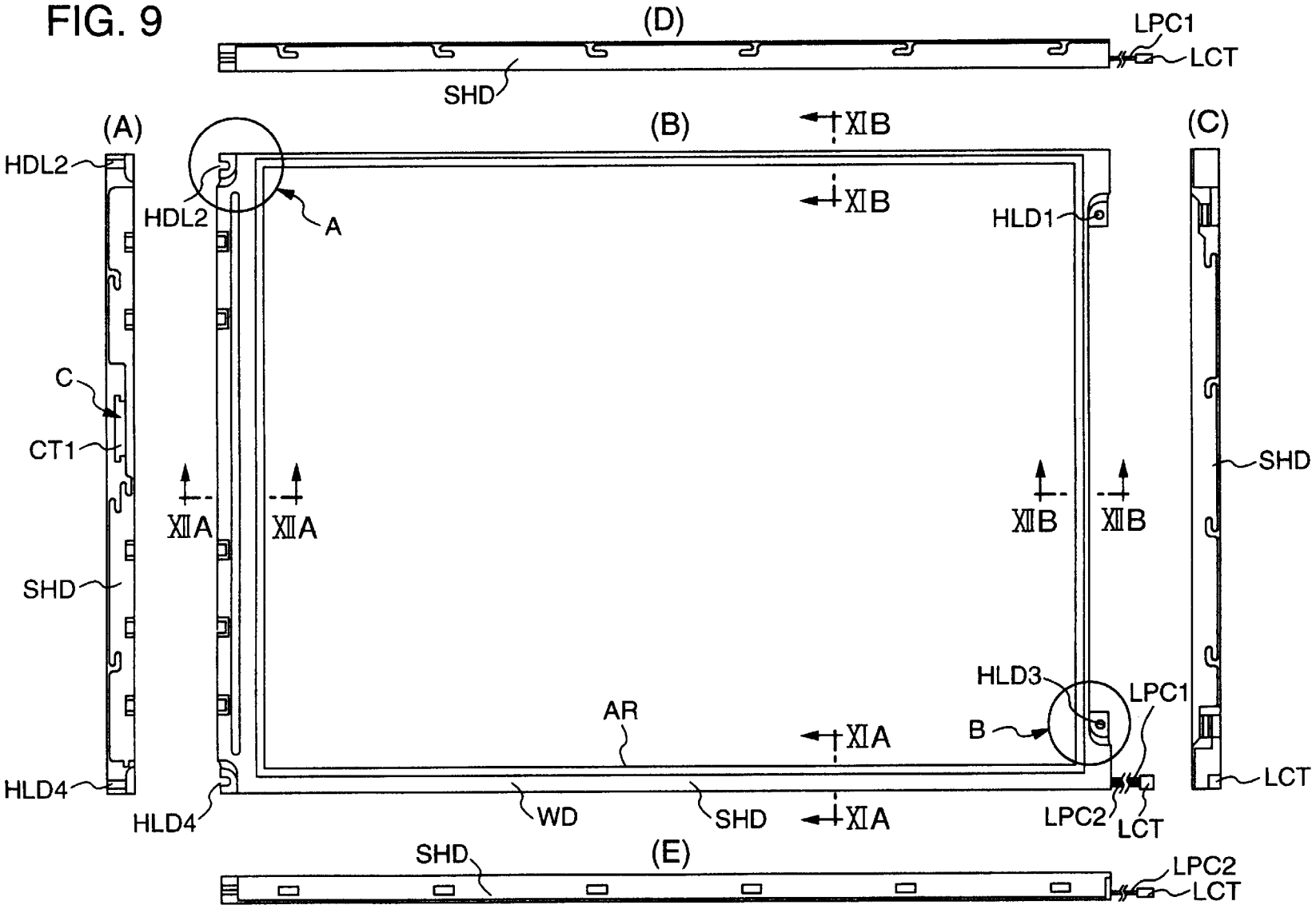
FIG. 9 shows, in a front view, a front side view, a right side view, a left side view and a rear side view, a completely assembled liquid crystal display module according to an embodiment of the present invention, when viewed from the display screen side of a liquid crystal display panel.
Figure 10:
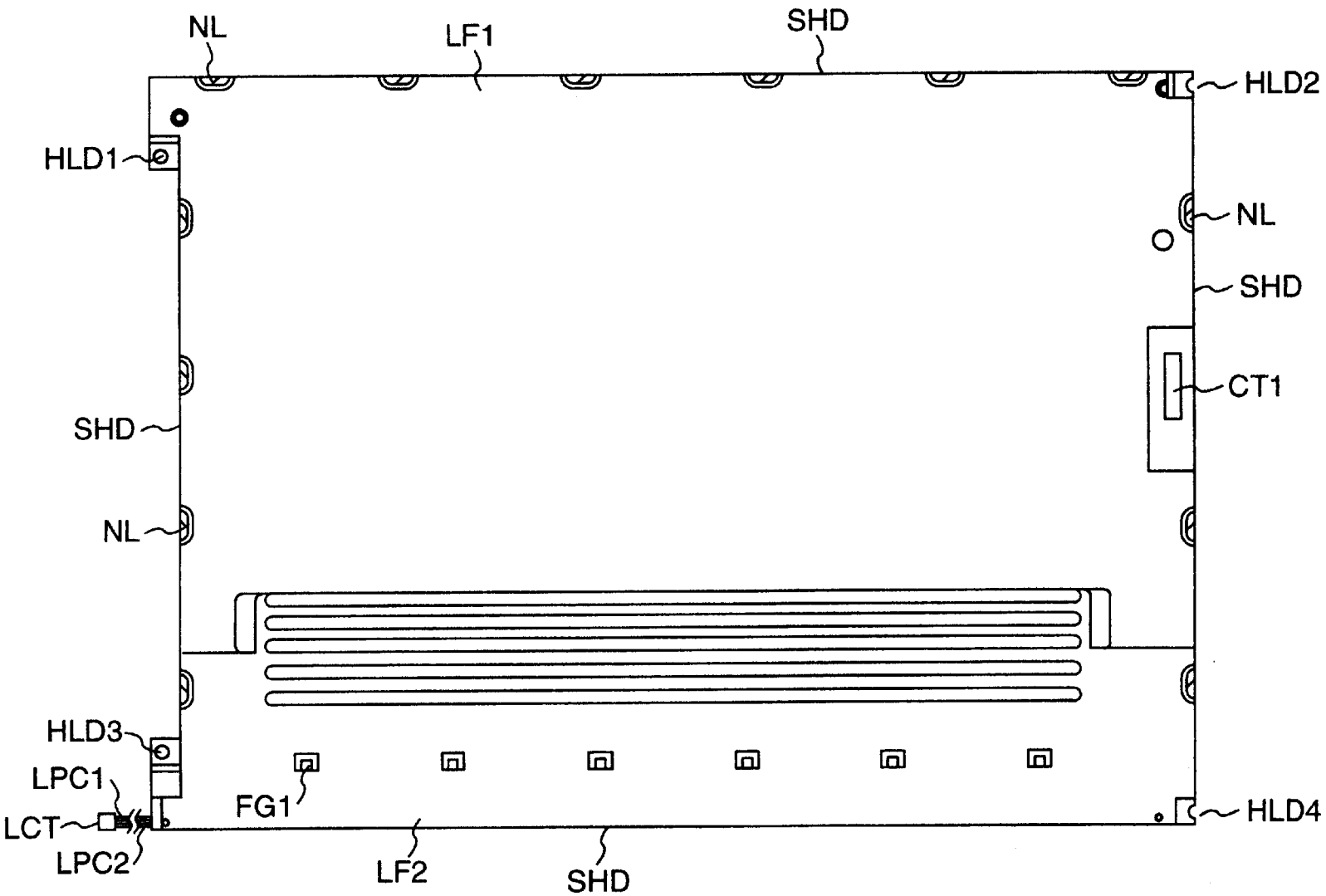
FIG. 10 illustrates the completely assembled liquid crystal display module illustrated in FIG. 9, viewed from the rear side of the liquid crystal display panel.

FIG. 9 shows a completely assembled liquid crystal display module in a front view, a top view, a right side view, a left side view and a bottom view according to this embodiment of the present invention, when viewed from the display screen side of the liquid crystal display panel. FIG. 10 illustrates the completely assembled liquid crystal display module of this embodiment when viewed from the rear side of the liquid crystal display panel.

The liquid crystal display module of this embodiment comprises a mold case ML and a shield case SHD. Mounting holes HLD1, HLD2, HLD3, HLD4 are formed through the mold case ML and the shield case SHD, respectively. The liquid crystal display module is mounted to a notebook type personal computer or the like with screws or the like screwed into these mounting holes. An invertor circuit unit for driving a back light unit is positioned in a recess formed between the mounting holes HLD1, HLD2 and supplies a drive voltage to a cold cathode fluorescent lamp LP through a connector LCT and lamp cables LCP1, LCP2.

Display data, display control signals and power supply from the computer side are supplied to the interface unit 100 through an interface connector CT1 positioned on the rear surface of the module.

It should be noted that in spite of the fact that the liquid crystal display module of this embodiment has a larger outer dimension and a larger display area AR than liquid crystal display panels of the SVGA display mode, a marginal region having no contribution to display can be reduced. Therefore, by equipping the liquid crystal display module of this embodiment in a portable information processing apparatus such as a notebook type personal computer or the like, a larger display with a higher visibility can be provided without hindering the portability of the apparatus.

Figures 11A, 11B:
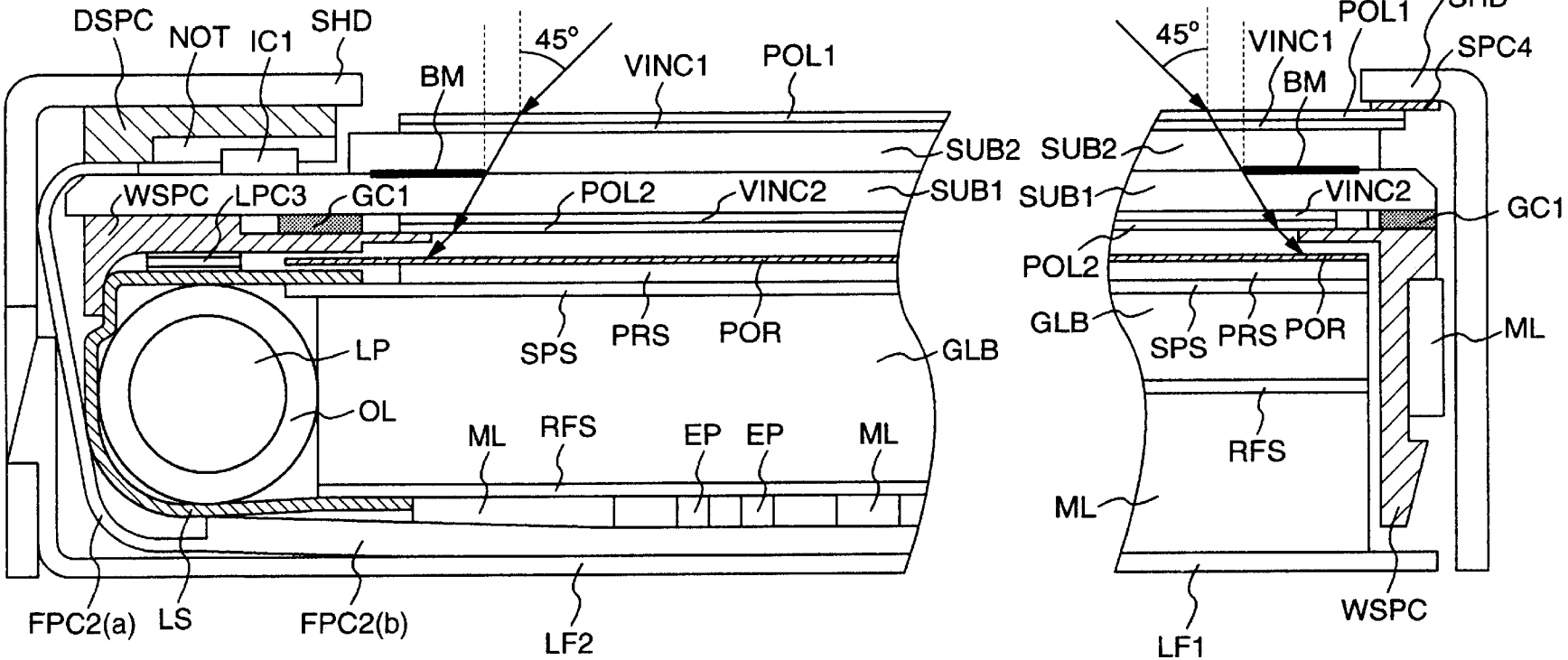
FIGS. 11A and 11B are cross-sectional views taken along a line XIA—XIA and a line XIB—XIB shown in FIG. 9, respectively.
Figure 12B:
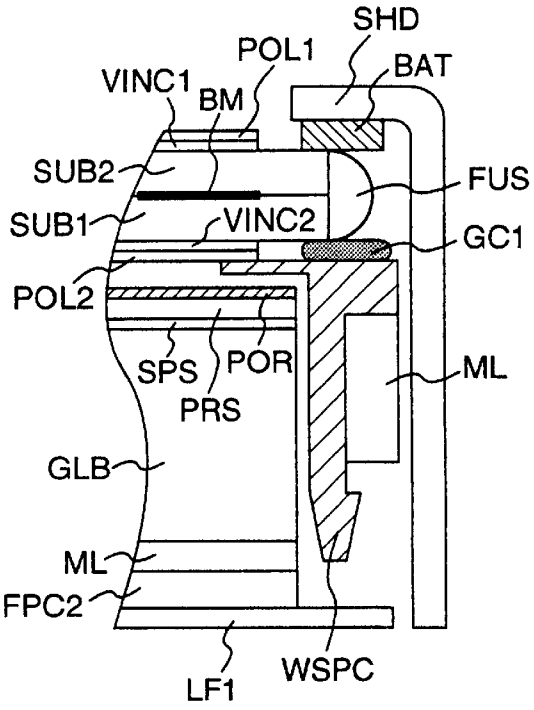
FIGS. 12A and 12B are cross-sectional views taken along a line XIIA—XIIA and a line XIIB—XIIB shown in FIG. 9, respectively.
Figure 12A:
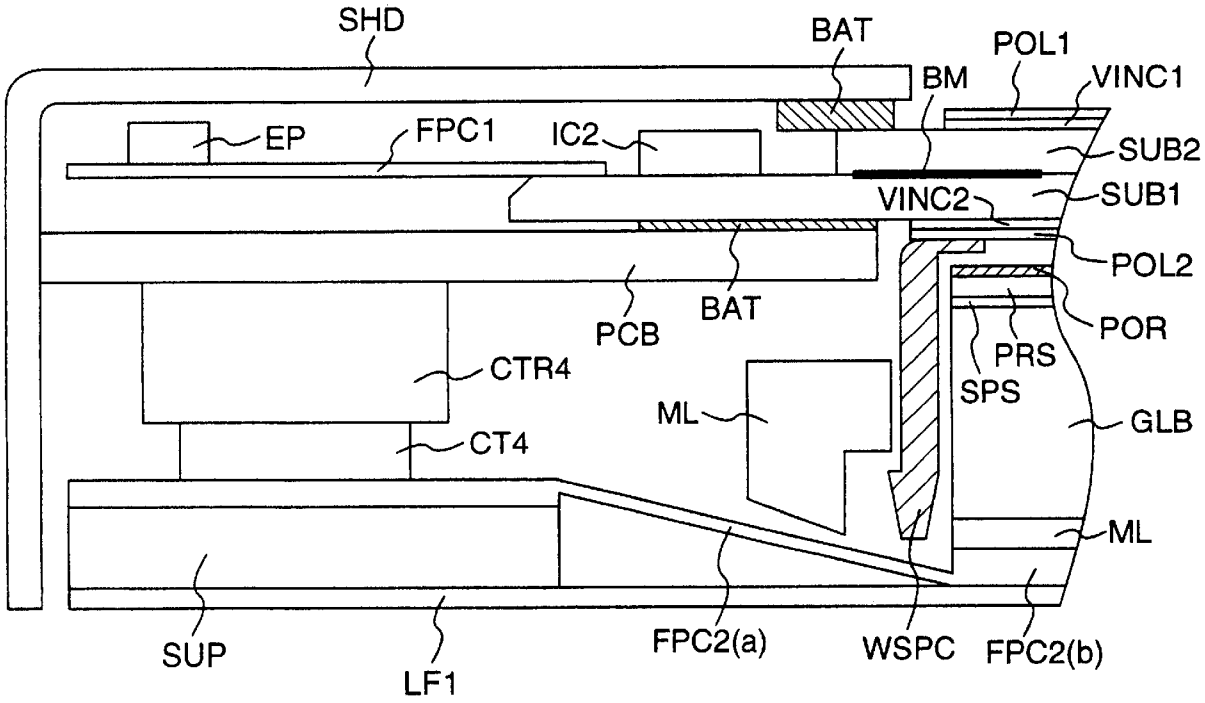

FIG. 11A is a cross-sectional view of the liquid crystal display module illustrated in FIG. 9 taken along a line XIA—XIA in FIG. 9; FIG. 11B is a cross-sectional view of the liquid crystal display module taken along a line XIB—XIB; FIG. 12A is a cross-sectional view of the liquid crystal display module taken along a line XIIA—XIIA; and FIG. 12B is a cross-sectional view of the liquid crystal display module taken along a line XIIB—XIIB.

In FIGS. 11A, 11B, 12A, 12B, the liquid crystal display module comprises a shield case (upper case) SHD for covering the periphery of the liquid crystal display panel and a driving circuit for the liquid crystal display panel; a mold case (lower case) ML for accommodating a back light unit; and first and second lower shield cases LF1 and LF2 for covering the lower case ML.

The liquid crystal display module also comprises a frame spacer WSPC for covering the periphery of the back light unit; and glass substrates SUB1, SUB2 constituting the liquid crystal display panel. In FIG. 12, the glass substrate SUB1 is a substrate on which thin film transistors TFT and pixel electrodes ITO1 are formed, while the glass substrate SUB2 is a substrate on which color filters and a common electrode are formed.

The liquid crystal display module further comprises a sealing compound FUS; a light shielding film BM formed on the glass substrate SUB2; an upper polarizing plate POL1 adhered to the glass substrate SUB2; a lower polarizing plate POL2 adhered to the glass substrate SUB1; a view extending film VINC1 adhered to the glass substrate SUB2; and a view extending film VINC2 adhered to the glass substrate SUB2.

In this embodiment, the view extending films are adhered to the glass substrates SUB1, SUB2 to eliminate the view dependency, that is, a problem particular to the liquid crystal display panel which exhibits varied contrast depending on an angle at which the user views the liquid crystal display panel. While the view extending films VINC1, VINC2 may be adhered outside of the polarizing plates POL1, POL2, a view extending effect can be enhanced by positioning the view enlarging films VINC1, VINC2 between the polarizing plates POL1, POL2 and the glass substrates SUB1, SUB2.

The liquid crystal display module further comprises a cold cathode fluorescent lamp LP; a lamp reflection sheet LS; a light guide plate GLB; a reflecting sheet RFS; and a prism sheet PRS. A polarized light reflecting plate POR is provided for improving the luminance of the liquid crystal display panel. The polarized light reflecting plate POR has properties of transmitting light along a particular polarizing axis and reflecting light along other polarizing axes. Therefore, by matching the polarizing axis of light transmitted by the polarized light reflecting plate POR with the polarizing axis of the lower polarizing plate POL2, light previously absorbed by the lower polarizing plate POL2 is also transformed into polarized light transmitting the lower polarizing plate POL2 and emitted from the polarized light reflecting plate POR while the light is shuffling between the polarized light reflecting plate POR and the light guide plate BLB, thereby making it possible to improve the contrast of the liquid crystal display panel.

The frame spacer WSPC securely fixes the light guide plate GLB to the mold case ML by pressing peripheral portions of the light guide plate GLB and inserting hooks of the frame spacer WSPC into holes of the mold case ML to prevent the light guide plate GLB from colliding with the liquid crystal display panel. In addition, since a diffusion sheet SPS, the prism sheet PRS and the polarized light reflecting plate POR are also pressed down by the frame spacer WSPC, the back light unit can be mounted to the liquid crystal display module without causing distorted diffusion sheet SPS, prism sheet PRS and polarized light reflecting plate POR.

A rubber cushion GS1 is provided between the frame spacer WSPC and the glass substrate SUB1. A lamp cable LPC3, for supplying the cold cathode fluorescent lamp LP with a drive voltage, is formed of a flat cable so as to require a less mounting space, and disposed between the frame spacer WSPC and the lamp reflection sheet LS. Since the lamp cable LPC3 is adhered to the lamp reflecting sheet LS with a double-coated adhesive tape, the lamp cable can be removed together with the lamp reflecting sheet LS when the cold cathode fluorescent lamp LP is replaced. Since the lamp cable LPC3 need not be removed from the lamp reflecting sheet LS, the replacement of the cold cathode fluorescent lamp LP can be readily achieved.

An O-ring OL serves as a cushion between the cold cathode fluorescent lamp LP and the lamp reflecting sheet LS. The O-ring OL may be made of a transparent synthetic resin material so as not to reduce the luminance of light emitted from the cold cathode fluorescent lamp LP. Also, the O-ring OL may be made of an insulating material having a low dielectric coefficient for preventing a high frequency current from leaking from the cold cathode fluorescent lamp LP. The O-ring OL further serves as a cushion for preventing the cold cathode fluorescent lamp LP from colliding with the light guide light GLB.

A semiconductor chip IC1, which implements the drain drivers 130 for supplying video voltages to the drain signal lines D of the liquid crystal display panel 10, is mounted on the glass substrate SUB1. Since this semiconductor chip IC1 is mounted only on one side of the glass substrate SUB1, it is possible to reduce a marginal region of the side opposite to the side on which the semiconductor chip IC1 is mounted. Also, since the cold cathode fluorescent lamp LP and the lamp reflecting sheet LS are disposed in a stacked manner below a portion of the glass substrate SUB1, on which the semiconductor chip IC1 is mounted, the cold cathode fluorescent lamp LP and the lamp reflecting sheet LS can be compactly accommodated in the liquid crystal display module.

A semiconductor chip IC2, which implements the gate drivers 140 for supplying scan drive voltages to the gate signal lines G of the liquid crystal display panel 10, is mounted on the glass substrate SUB1. Since this semiconductor chip IC2 is also mounted only on one side of the glass substrate SUB1, it is possible to reduce a marginal region of the side opposite to the side on which the semiconductor chip IC2 is mounted.

A flexible printed wiring board FPC1 on the gate signal line side is connected to external terminals on the glass substrate SUB1 through an anisotropic conductive film for supplying the semiconductor chip IC2 with a power supply and a driving signal. A flexible printed wiring board FPC2 on the drain signal line side is connected to external terminals on the glass substrate SUB1 through an anisotropic conductive film for supplying the semiconductor chip IC1 with a power supply and a driving signal. The flexible printed wiring boards FPC1, FPC2 have mounted thereon chips and parts EP such as resistors, capacitors and so on.

In this embodiment, the flexible printed wiring board FPC2 is folded, and a portion (portion b) of the flexible printed wiring board FPC2 is sandwiched and fixed between the mold case ML and the second shield case at the back of the back light unit so as to envelop the lamp reflecting sheet LS, in order to reduce the marginal region of the liquid crystal display panel 10. Due to this structure, the mold case ML is provided with a cut-out portion for ensuring a spacer for chips and parts EP mounted on the flexible printed wiring board FPC2.

The flexible printed wiring board FPC2 comprises a reduced thickness portion (portion a) for facilitating the folding thereof, and a larger thickness portion (portion b) for multiple wiring layers. Also, in this embodiment, the lower shield case is composed of a first lower shield case LF1 and a second lower shield case LF2 such that the rear surface of the liquid crystal display module is covered with the two lower shield cases LF1, LF2. Thus, the lamp reflecting sheet LS can be exposed only by removing the second lower shield case LF2, so that the cold cathode fluorescent lamp LP can be readily replaced.

An interface board PCB, on which the display control unit 110 and the power supply circuit 120 are mounted, is also formed of a multi-layer printed wiring board. In this embodiment, the interface board PCB is disposed in a stacked manner below the flexible printed wiring board FPC1, and adhered to the glass substrate SUBI with a double-coated adhesive tape BAT, in order to reduce the marginal region of the liquid crystal display panel 10.

The interface board PCB is provided with a connector CTR3 and a connector CTR4, where the connector CTR4 is electrically connected to a connector CT4 of the flexible printed wiring board FPC2. Similarly, the connector CTR3 is electrically connected to a connector CT3 of the flexible printed wiring board FPC1. The interface board PCB is also equipped with a semiconductor chip which implements the receivers 160*a*, 160*b*.

Figure 13:
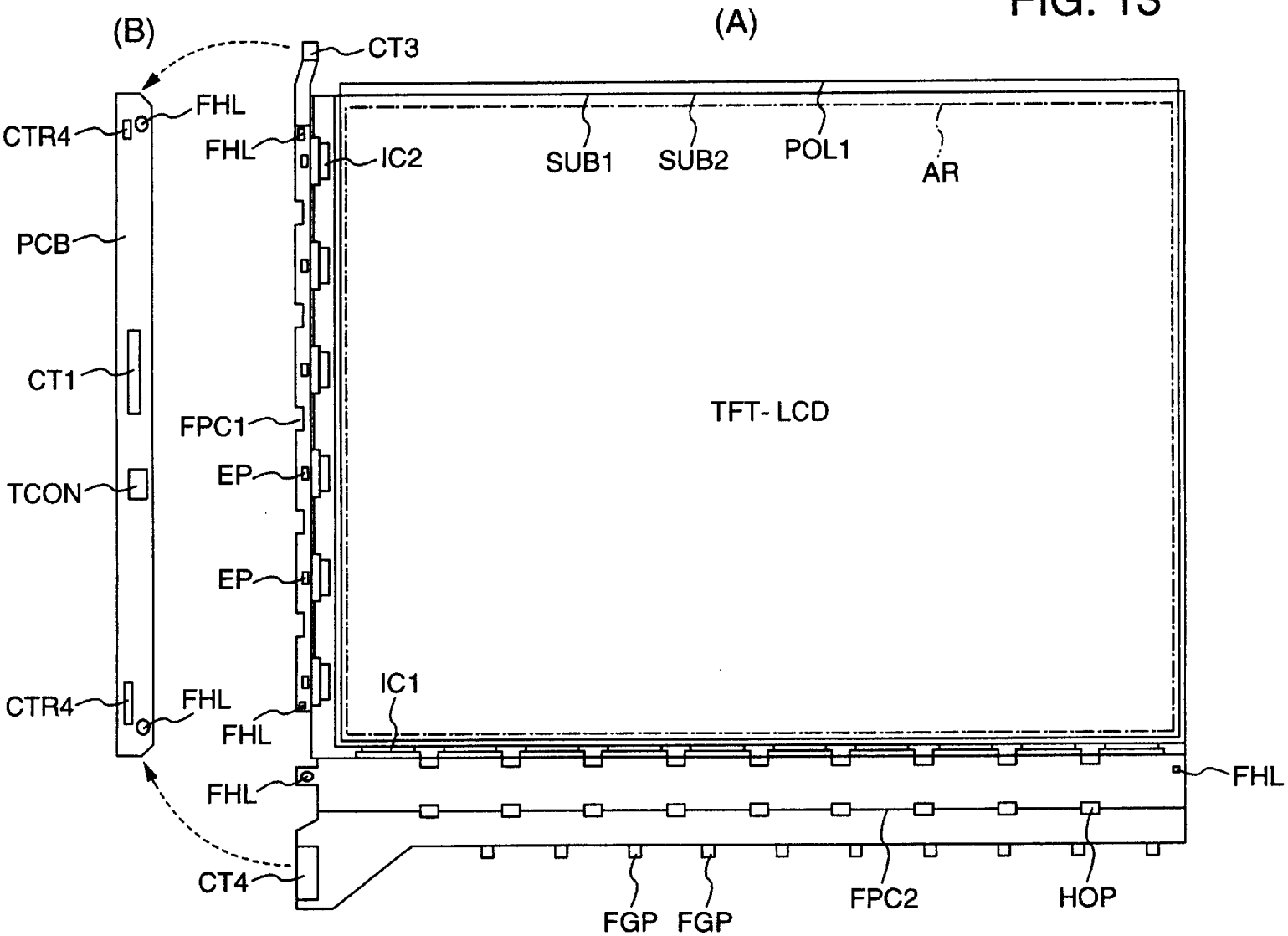
FIG. 13 is a diagram illustrating a flexible printed wiring board and another flexible printed wiring board, before folded, which are mounted on peripheral sides of a liquid crystal display panel in a liquid crystal display module according to an embodiment of the present invention.
Figure 14:
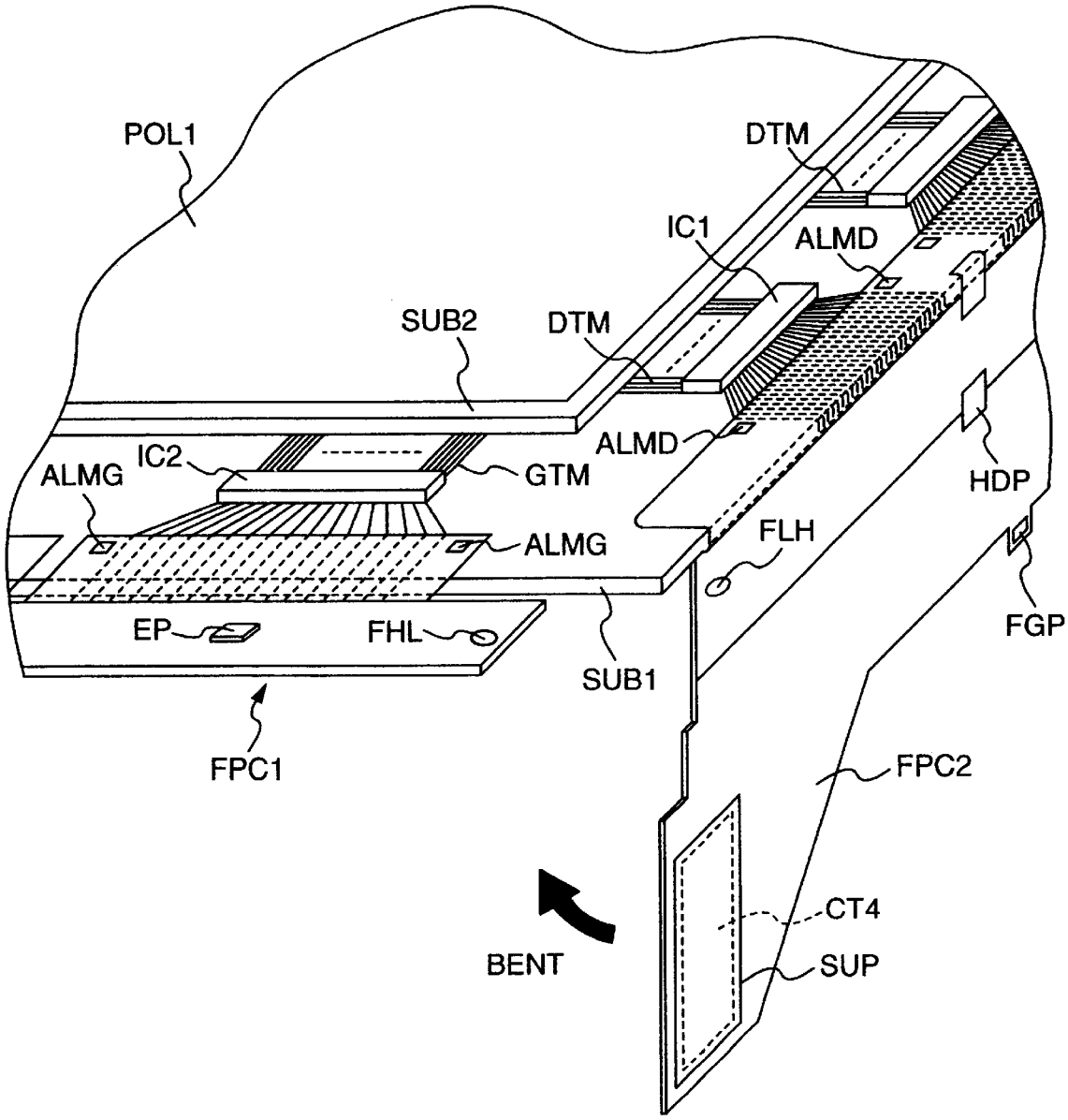
FIG. 14 is an enlarged view illustrating in greater detail a portion of FIG. 13 in which the liquid crystal display panel is connected to the flexible printed wiring boards.

FIG. 13 illustrates the liquid crystal display panel 10 with the flexible printed wiring board FPC1 and the flexible printed wiring board FPC2, before folded, which are mounted on peripheral sides of the liquid crystal display panel 10. FIG. 14 is an enlarged view illustrating in greater detail a portion of FIG. 13 in which the liquid crystal display panel 10 is connected to the flexible printed wiring boards FPC1, FPC2.

In FIGS. 13, 14, the liquid crystal display panel 10 comprises a semiconductor chip TCON for implementing the display control unit 110; drain terminals DTM; and gate terminals GTM.

Referring back to FIGS. 11, 12, a reinforcing plate SUB is disposed between the lower shield case LF1 and the connector CT4 so as to prevent the connector CT4 from coming off the connector CTR4. A spacer SPC4 is provided between the shield case SHD and the upper polarizing plate POL1, made of unwoven fabric, and adhered to the shield case SHD with an adhesive.

In this embodiment, the upper polarizing plate POL1 and the view extending film VINC1 are extracted from the glass substrate SUB2 such that the upper polarizing plate POL1 and the view extending film VINC1 are pressed by the shield case SHD. In this embodiment, this structure ensures a sufficient mechanical strength of the entire liquid crystal display panel even if the marginal region is reduced.

A drain spacer DSPC is provided between the shield case SHD and the glass substrate SUB1 for preventing the shied case SHD from colliding with the glass substrate SUB1. Also, since the drain spacer DSPC is disposed to overlie the semiconductor chip IC1, the drain spacer DSPC is formed with a notch NOT through a portion corresponding to the semiconductor chip IC1. This prevents the shield case SHD and the drain spacer DSPC from colliding with the semiconductor chip IC1. Also, since the drain spacer DSPC presses the flexible printed wiring board FPC2 positioned on the external connecting terminal of the glass substrate SUB1, the flexible printed wiring board FPC2 is prevented from peering off the glass substrate SUB1. A sealing compound FUS is provided for sealing a liquid crystal encapsulating port of the liquid crystal display panel.

Figure 15A:
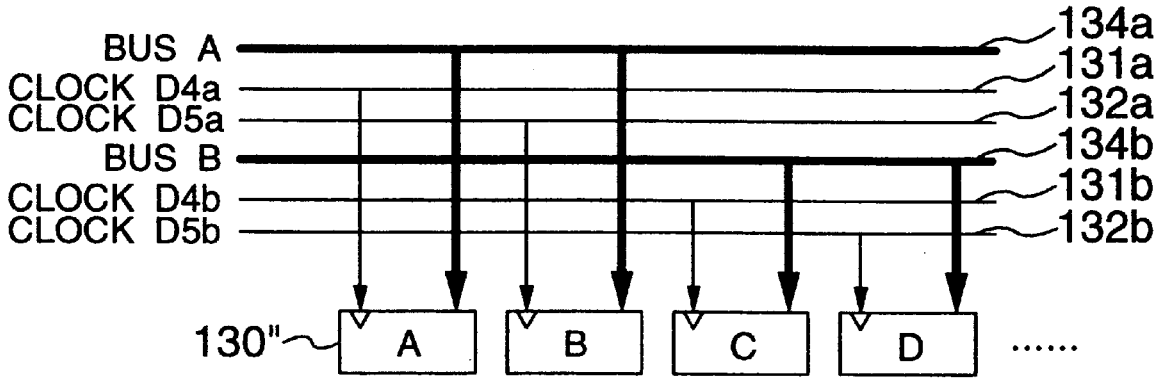
FIG. 15A is a block diagram illustrating a general configuration of a main portion of a liquid crystal display module according to another embodiment of the present invention.
Figure 15B:
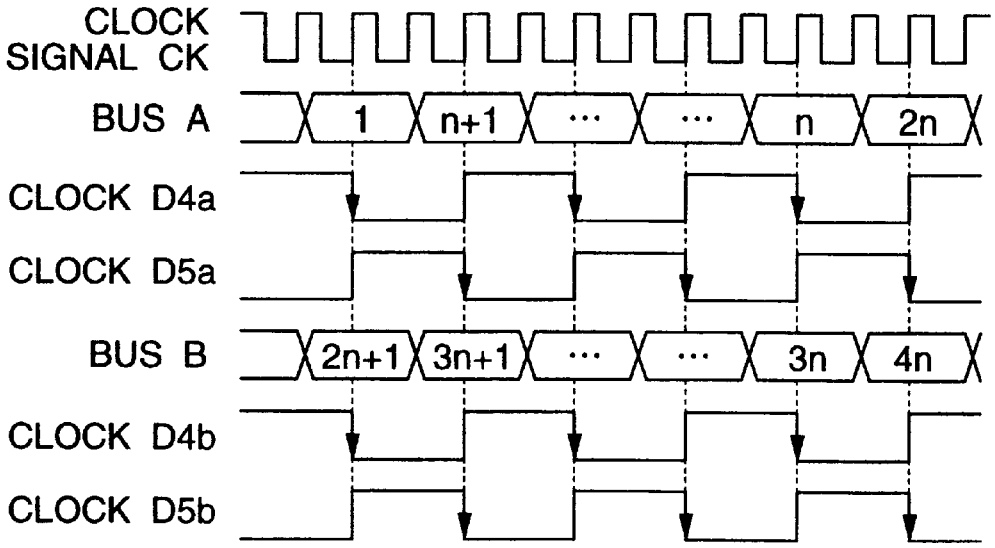
FIG. 15B illustrates timing charts of clocks and signals on buses in the circuit of FIG. 15A.

FIG. 15A is a block diagram illustrating a general configuration of a main portion of a liquid crystal display module according to another embodiment of the present invention, and FIG. 15B illustrates timing charts of clocks and signals associated with the circuit of FIG. 15A.

In this embodiment, as illustrated in FIG. 15A, two bus lines 134*a*, 134*b* are provided for display data A and display data B, respectively, as bus lines for display data from a display control unit 110, such that display data is supplied to $(4m-3)^{th}$ and $(4m-2)^{th}$ drain drivers 130" (m=1, . . . , n) through the bus line (bus A) 134*a* for the display data A, and display data is supplied to $(4m-1)^{th}$ and $(4m)^{th}$ drain drivers 130" (m=1, . . . , n) through the bus line (bus B) 134*b* for the display data B.

Also, the $(4m-3)^{th}$ drain drivers 130 are supplied with a clock signal D4*a* serving as a clock signal for latching display data through a signal line 131*a;* the $(4m-2)^{th}$ drain drivers 130" are supplied with a clock signal D5*a* through a signal line 132*a;* the $(4m-1)^{th}$ drain 130" are supplied with a clock signal D4*b* through a signal line 131*b;* and the $(4m)^{th}$ drain drivers 130" are supplied with a clock signal D5*b* through a signal line 132*b*.

With this configuration, the display control unit 110 distributes and reorders originally ordered display data received from the computer side to transmit the reordered display data to the $(4m-3)^{th}$ and $(4m-2)^{th}$ drain drivers 130", and to the $(4m-1)^{th}$ and $(4m)^{th}$ drain drivers 130", as illustrated in the timing charts of FIG. 15B.

Since the liquid crystal display module of this embodiment is provided with two display data bus lines, it is possible to further reduce the frequency of the clock signals D4*a*, D4*b*, D5*a*, D5*b* for latching display data. As can be seen from the timing charts of FIG. 15B, the clock signals D4*a* and D4*b* are in phase, and the clock signals D5*a* and D5*b* are also in phase, so that only the clock signal D4*a* and the clock signal D5*a* may be used as clock signals for latching display data transmitted from the display control unit 110 to the drain drivers 130".

Figure 16A:
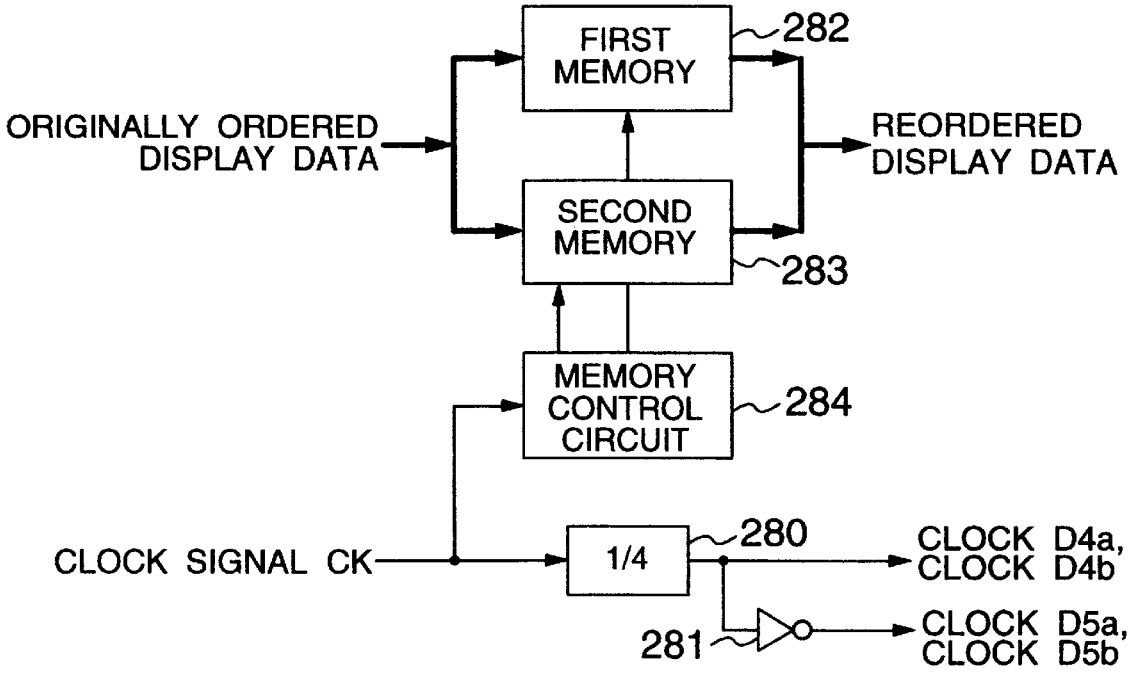
FIG. 16A is a block diagram illustrating an exemplary circuit configuration of a portion for reordering display data and a portion for generating clock signals in a display control unit illustrated in FIGS. 15A and 15B.

FIG. 16A illustrates an example of a circuit configuration of a portion for reordering display data and a portion for generating the clock signals D4*a*, D4*b*, D5*a*, D5*b* in the display control unit 110, and FIG. 4B illustrates timing charts of display data and the clock signals D4*a*, D4*b*, D5*a*, D5*b* sent from the display control unit 110.

In the example illustrated in FIG. 15A, a clock signal CK at 65 MHz transmitted from the computer side is divided by a drive-by-4 frequency divider circuit 280 which produces clock signals D4*a*, D4*b*. In addition, portions of the clock signals D4*a*, D4*b* are phase-inverted by an inverter circuit 281 which produces clock signals D5*a*, D5*b*.

Also, originally ordered display data transmitted from the computer side are inputted to a first memory 282 (or a second memory 283). The first memory 282 (and the second memory 283) stores display data of an amount corresponding to a total number 4n of the drain signal lines D connected to four drain drivers 130" (n being a positive integer).

Figure 16B:
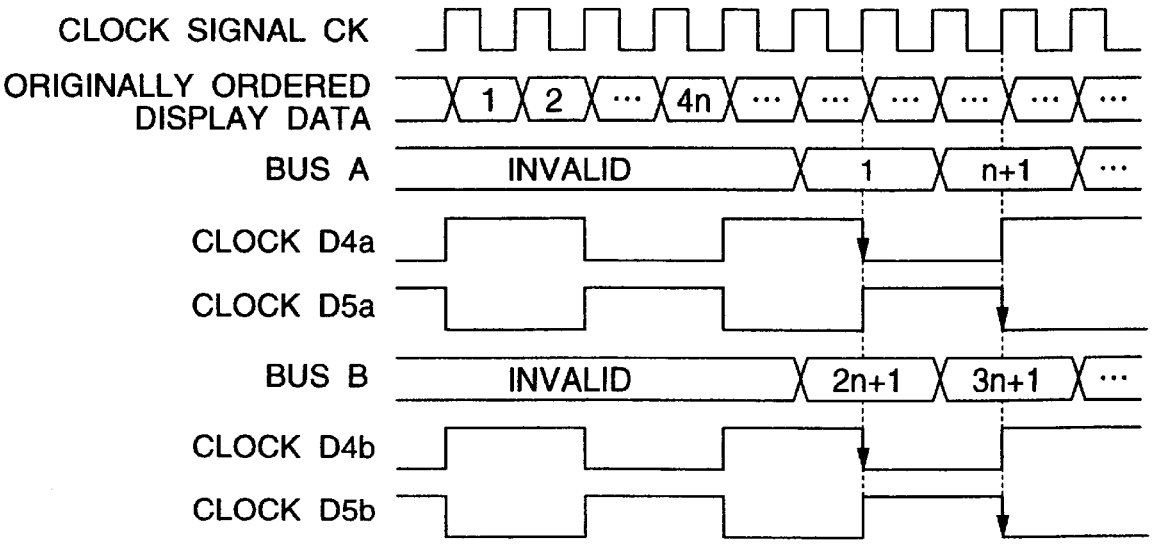
FIG. 16B illustrates timing charts of display data and clock signals sent from the display control unit.

In the example illustrated in FIG. 16A, the 4n originally ordered display data transmitted from the computer side are first written, for example, into the first memory 282. When 4n display data are stored in the first memory 282, next 4n display data transmitted from the computer side are written into the second memory 283, and meanwhile the display data are read from the first memory 282 in an order shown in FIG. 16B and outputted to the drain drivers 130" through the display data bus lines BUS A and BUS B.

A memory control circuit 284 controls writing and reading operations of the first and second memories 282, 283.

While the respective embodiments have been described for the case where the present invention is applied to a TFT-based liquid crystal display apparatus, it goes without saying that the present invention is not limited to this particular type of liquid crystal display apparatus, may also be applicable to STN-based simple matrix type liquid crystal display apparatus.

Thus, while the invention created by the present inventors has been specifically described based on the foregoing embodiments thereof, it will be of course appreciated that the present invention is not limited to the foregoing embodiments but may be modified in various manners without departing from the spirit and scope of the invention set forth in the appended claims.

According to the embodiments described above, in a liquid crystal display apparatus comprising a high resolution liquid crystal display panel, the frequency of clock signals sent to driving means can be lowered without increasing the bus width of a display data bus line.

Also, according to the embodiments described above, since a signal line is only added to a printed wiring board for lowering the frequency of the clock signals, a lowered frequency of the clock signals can be achieved without requiring an increase in the number of pins for display control means, and multiple layers and increased areas for printed wiring boards, while incurring a minimum increase in cost.

What is claimed is:

1. A liquid crystal display apparatus comprising:

a liquid crystal display panel having a plurality of pixels formed in a matrix configuration;

M driving means for applying a plurality of pixels arranged in a column direction with video voltage based on display data, where M is a positive integer; and display control means for sending inputted display data to said M driving means, and for generating control signals including at least a plurality of clock signals based on input display control signals inputted thereto and sending said control signals to said M driving means to control and drive said M driving means, said display control means including:

reordering means for reordering originally ordered display data inputted thereto and sending the reordered display data to said M driving means; and clock generating means for generating N clock signals having the same frequency as and different phases from each other, where N is a positive integer smaller than M, and sending said N clock signals to N driving means groups, each of said driving means groups comprising M/N driving means.

2. A liquid crystal display apparatus according to claim 1, wherein said reordering means of said display control means includes:

at least N memories for storing display data, the amount of said display data corresponding to the number of pixels in the column direction, to which video voltages are applied from said driving means; and control means for writing the originally ordered display data inputted thereto into said memory, changing a reading order of said display data from said memory to reorder the originally ordered display data inputted thereto, and sending the reordered display data to said M driving means.

3. A liquid crystal display apparatus according to claim 1, wherein said display control means transmits display data to said N driving means through a bus line, and said plurality of clock signals comprise first and second clock signals having the same frequency as a display operation frequency of said display data and having different phases from each other.

4. A liquid crystal display apparatus according to claim 3, wherein said second clock signal is an inverted signal of said first clock signal.

5. A liquid crystal display apparatus according to claim 1, wherein said display data and said input display control signals are inputted from a computer side to said display control means in a low amplitude differential form.

6. A liquid crystal display apparatus according to claim 1, wherein the reordering means sends the reordered display data to the M driving means through a single bus line.

7. A liquid crystal display apparatus comprising:

a liquid crystal display panel having a plurality of pixels formed in a matrix configuration;

M driving means for applying a plurality of pixels arranged in a column direction with video voltage based on display data, where M is a positive integer; and display control means for sending inputted display data to said M driving means, and for generating control signals including at least a plurality of clock signals based on input display control signals inputted thereto and sending said control signals to said M driving means to control and drive said M driving means, said display control means including:

distributing and reordering means for distributing and reordering originally ordered display data to generate K series of display data, where K is a positive integer smaller than M, and sending said K series of display data to K driving means groups, each of said driving means groups comprising M/K driving means; and clock generating means for generating N clock signals having the same frequency as and different phases from each other, and sending said N clock signals to N driving means groups, each of said driving means groups comprising M/N driving means, where N is a positive integer smaller than M.

8. A liquid crystal display apparatus according to claim 7, wherein said display data and said input display control signals are inputted from a computer side to said display control means in a low amplitude differential form.

9. A liquid crystal display apparatus according to claim 7, wherein the distributing and reordering means sends the K series of display data to the K driving means groups through K single bus lines, respectively; and wherein the clock generating means sends the N clock signals to each of the K driving means groups.

10. A liquid crystal display apparatus comprising:

a liquid crystal display panel having a plurality of pixels formed in a matrix configuration;

a plurality of driving means for applying a plurality of pixels arranged in a column direction with video voltage based on display data; and display control means for sending inputted display data to the plurality of driving means, and for generating control signals including at least a plurality of clock signals based on input display control signals inputted thereto and sending the control signals to the plurality of driving means to control and drive the plurality of driving means;

wherein the display control means includes:

reordering means for reordering originally ordered display data inputted thereto and sending the reordered display data to M driving means, where M is a positive integer; and clock generating means for generating N clock signals having the same frequency as and different phases from each other, where N is a positive integer smaller than M, and sending the N clock signals to each of the M driving means.

11. A liquid crystal display apparatus according to claim 10, wherein the clock generating means sends the N clock signals to N driving means groups, each of the N driving means groups including M/N ones of the M driving means.

12. A liquid crystal display apparatus according to claim 10, wherein the reordering means sends the reordered display data to the M driving means through a single bus line.

13. A liquid crystal display apparatus comprising:

a liquid crystal display panel having a plurality of pixels formed in a matrix configuration;

a plurality of driving means for applying a plurality of pixels arranged in a column direction with video voltage based on display data; and display control means for sending inputted display data to the plurality of driving means, and for generating control signals including at least a plurality of clock signals based on input display control signals inputted thereto and sending the control signals to the plurality of driving means to control and drive the plurality of driving means;

wherein the display control means includes:

distributing and reordering means for distributing and reordering originally ordered display data to generate K series of display data, where K is a positive integer, and sending the K series of display data to K driving means groups; and clock generating means for generating N clock signals having the same frequency as and different phases from each other, where N is a positive integer, and sending the N clock signals to the plurality of driving means;

wherein the clock generating means sends the N clock signals to each of the K driving means groups.

14. A liquid crystal display apparatus according to claim 13, wherein the distributing and reordering means sends the display data to M driving means, where M is a positive integer larger than both K and N; and wherein the clock generating means sends the N clock signals to N driving means groups, each of the driving means groups including M/N ones of the M driving means.

15. A liquid display apparatus according to claim 13, wherein the display control means sends the control signals to M driving means to control and drive the M driving means, where M is a positive integer larger than both K and N;

wherein each of the K driving means groups includes M/K ones of the M driving means; and wherein the distributing and reordering means sends the K series of display data to the K driving means groups through K bus lines, respectively.

16. A liquid crystal display apparatus according to claim 15, wherein the clock generating means sends the N clock signals to N driving means groups, each of the N driving means groups including M/(N·K) ones of the M driving means.

17. A liquid crystal display apparatus according to claim 13, wherein the distributing and reordering means sends the K series of display data to the K driving means groups through K single bus lines, respectively.

* * * * *